US011027175B2

(12) United States Patent
Sizemore, Jr.

(10) Patent No.: US 11,027,175 B2
(45) Date of Patent: Jun. 8, 2021

(54) ADJUSTABLE INTERCHANGEABLE COMPONENT GOLF CLUB HEAD

(71) Applicant: Bruce E. Sizemore, Jr., Farmington, MI (US)

(72) Inventor: Bruce E. Sizemore, Jr., Farmington, MI (US)

(73) Assignee: Mod Golf Technologies, LLC, Jackson, MI (US)

( * ) Notice: Subject to any disclaimer, the term of this patent is extended or adjusted under 35 U.S.C. 154(b) by 0 days.

(21) Appl. No.: 16/066,549

(22) PCT Filed: Jan. 5, 2017

(86) PCT No.: PCT/US2017/012403

§ 371 (c)(1),
(2) Date: Jun. 27, 2018

(87) PCT Pub. No.: WO2017/120389

PCT Pub. Date: Jul. 13, 2017

(65) Prior Publication Data

US 2019/0001196 A1 Jan. 3, 2019

Related U.S. Application Data

(60) Provisional application No. 62/275,138, filed on Jan. 5, 2016.

(51) Int. Cl.
*A63B 53/06* (2015.01)
*A63B 53/02* (2015.01)
(Continued)

(52) U.S. Cl.
CPC ..... *A63B 53/02* (2013.01); *A63B 53/047* (2013.01); *A63B 53/06* (2013.01); *A63B 60/02* (2015.10);
(Continued)

(58) Field of Classification Search
CPC . A63B 2053/0416; A63B 53/06; A63B 53/04; A63B 53/021; A63B 53/022; A63B 53/023
(Continued)

(56) References Cited

U.S. PATENT DOCUMENTS 3,893,670 A * 7/1975 Franchi ..... A63B 53/06 473/288
4,422,638 A 12/1983 Tucker
(Continued)

OTHER PUBLICATIONS

JSME International Journal-Series C, vol. 41, No. 4, 1998—Takuzo Iwatsubo, Shozo Kawamura, Kazuyoshi Miyamoto, Tetsuo Yamaguchi—Analysis of Golf Impact Phenomenon and Ball Trajectory.
(Continued)

*Primary Examiner* — Alvin A Hunter
(74) *Attorney, Agent, or Firm* — Warner Norcross + Judd LLP

(57) ABSTRACT

An adjustable interchangeable golf club with a faceplate-based platform to receive components for enhancing and controlling various aspects that control the golf ball flight and spin characteristics. Disclosed are components for adjusting loft and bounce angle, and interchangeable faceplate and rear flange styles. Novel milled surface roughness for enhanced spin control is disclosed along with new milling methods for achieving optimal surface roughness. Lightweight hosel and consequent redistribution of mass in club head greatly increases the inertia of the golf club. Centrally located hosel position aids in club head stability on off-center hits. This results in a golf club that hits the ball higher, straighter, longer, and with increased ball spin characteristics.

7 Claims, 20 Drawing Sheets

(51) Int. Cl.
*A63B 53/04* (2015.01)
*A63B 60/02* (2015.01)
*A63B 60/54* (2015.01)

(52) U.S. Cl.
CPC ..... *A63B 53/022* (2020.08); *A63B 60/54* (2015.10); *A63B 2053/0491* (2013.01)

(58) Field of Classification Search
USPC ..... 473/307, 324–350, 245, 246
See application file for complete search history.

(56) References Cited

U.S. PATENT DOCUMENTS 4,618,149 A * 10/1986 Maxel ..... A63B 53/06 473/245
4,884,808 A * 12/1989 Retzer ..... A63B 53/04 473/288
5,348,295 A * 9/1994 Phillips ..... A63B 53/02 473/307
5,509,660 A * 4/1996 Elmer ..... A63B 53/04 473/288
5,597,362 A * 1/1997 Lee ..... A63B 53/02 473/244
5,603,666 A * 2/1997 Bowe ..... A63B 53/02 473/307
5,620,381 A * 4/1997 Spalding ..... A63B 53/0487 473/329
5,807,186 A * 9/1998 Chen ..... A63B 53/04 473/248
5,816,931 A * 10/1998 Schooler ..... A63B 60/00 473/248
5,851,155 A * 12/1998 Wood ..... A63B 53/02 473/246
6,203,444 B1 * 3/2001 McRae ..... A63B 53/0487 473/244
6,224,496 B1 * 5/2001 Rowland ..... A63B 53/04 473/288
6,238,303 B1 * 5/2001 Fite ..... A63B 53/0487 473/342
6,264,571 B1 * 7/2001 Lekavich ..... A63B 53/02 473/340
6,309,310 B1 10/2001 Shira
6,863,620 B2 * 3/2005 Tucker, Sr. ..... A63B 53/0487 473/288
7,101,290 B2 * 9/2006 Tucker, Sr. ..... A63B 53/0487 473/340
7,335,112 B1 * 2/2008 Bitondo ..... A63B 53/0487 473/238
7,413,517 B2 * 8/2008 Butler, Jr. ..... A63B 53/04 473/288
7,416,494 B2 * 8/2008 Edel ..... A63B 53/007 473/288
7,553,240 B2 * 6/2009 Burnett ..... A63B 53/02 473/288
7,563,172 B2 * 7/2009 Mansfield ..... A63B 53/0487 473/288
7,604,550 B1 * 10/2009 Currie ..... A63B 53/047 473/342
7,658,685 B2 2/2010 Vokey et al.
7,691,006 B1 * 4/2010 Burke ..... A63B 53/06 473/288
7,963,855 B2 * 6/2011 Sander ..... A63B 53/0466 473/288
8,083,607 B2 * 12/2011 Clausen ..... A63B 53/047 473/291
8,088,019 B1 * 1/2012 Long ..... A63B 53/02 473/245
8,105,178 B2 * 1/2012 Sander ..... A63B 53/02 473/288
8,133,129 B2 * 3/2012 Boyd ..... A63B 53/047 473/288
8,496,540 B2 * 7/2013 Soracco ..... A63B 53/02 473/307
8,545,343 B2 * 10/2013 Boyd ..... A63B 53/04 473/288
8,556,745 B2 * 10/2013 Currie ..... A63B 53/047 473/342
8,616,996 B2 12/2013 Murphy
8,715,103 B1 * 5/2014 Aguinaldo ..... A63B 53/06 473/307
8,740,722 B2 6/2014 Sato
8,777,774 B1 7/2014 Kim et al.
8,821,307 B2 * 9/2014 Park ..... A63B 53/04 473/244
8,827,832 B2 9/2014 Breier et al.
8,858,361 B2 * 10/2014 Ripp ..... B21D 22/00 473/331
8,956,243 B2 2/2015 Kim et al.
8,979,670 B2 3/2015 Aguayo et al.
9,033,814 B2 * 5/2015 Stites ..... A63B 53/047 473/244
9,566,480 B2 2/2017 Voges
10,137,341 B2 * 11/2018 Greer ..... A63B 60/42
2013/0165251 A1 6/2013 Jorgensen
2013/0344984 A1 12/2013 Golden et al.
2014/0106894 A1 4/2014 Murphy
2014/0274441 A1 * 9/2014 Greer ..... A63B 53/047 473/290
2014/0274452 A1 9/2014 Oldknow
2015/0045142 A1 2/2015 Moreira et al.
2015/0231457 A1 * 8/2015 Sander ..... A63B 53/06 473/244
2016/0193511 A1 * 7/2016 Greer ..... A63B 60/42 473/290
2017/0151473 A1 6/2017 Voges

OTHER PUBLICATIONS

Dublin Institute of Technology—Arrow@DIT-Articles-School of Mechanical and Transport Engineering—David Kennedy, Yueqiang Xue, Emilia Mihaylova—Jan. 1, 2005 Current and Future Applications of Surface Engineering.
Sports Engineering—Mar. 2005, vol. 8, Issue 1, pp. 3-11—S.A. Monk, C. L. Davis, S.R. Otto, M. Strangwood—Material and surface effects on the spin and launch angle generated from a wedge/ball interaction in golf.

* cited by examiner

ADJUSTABLE INTERCHANGEABLE COMPONENT GOLF CLUB HEAD

BACKGROUND OF THE INVENTION

1. Field of the Invention

The present invention relates to golf clubs, and particularly relates to golf clubs with adjustable and interchangeable component features.

2. Description of the Prior Art

Conventional golf club designs have been made to enhance performance of the players of the game of golf. Many innovations have recently been made to golf club heads, including adjustable hosels, surface treatments to the striking face of the club head, as well as other attempted improvements for loft and lie angles, surface texturing to control spin of the ball once launched, among other attempted improvements.

However, each of those attempted improvements has met with somewhat less than hoped for and/or expected results. Individually, these improvements have been attempted, but to date, there has not been a completely interacting adjustable golf club. For example, starting at the hosel of the club, certain previous inventions have focused on an adjustable hosel without considering the impact that the adjustability feature has on the rest of the golf club. While adjusting the hosel without compensating other aspects may improve some of the performance characteristics, other angles are changed that may not be desired. In another regard, adjusting the bounce angle of the club has been attempted, but a limited number of positions are only possible. Prior art attempts to change the center of gravity have not met with optimal success when affecting the launch angle of the ball when struck. Other attempted improvements involved surface treatments to the striking face texture to help control spin on the ball.

It would be a real advantage to a golfer if the abovementioned advantages would be cooperative in behavior rather than singularly affecting various aspects of the golf club. Furthermore, it would be quite an accomplishment to have all aspects of adjustability cooperating interchangeable components with each other in order to form a more perfect golf club. Upon careful review of the prior art inventions, certain aspects of a golf club need to be analyzed in order to illustrate the advantages of the present invention.

First we will look at approved surface treatments and texturization of the striking face of a golf club. Certain features of the golf club have been modified through the years to improve various aspects of the game, such that golf club construction has been regulated by the United States Golf Association (USGA). In that regard, there are well founded criteria for the club head itself, such as those regulations dictating the depth and separation of golf club face grooves. Prior attempts have included milling the face in particular configurations, although none have achieved the optimum spin control.

Increased surface roughness of the striking face of a club head may provide some control over the spin of a golf ball once launched after striking. As such, the regulations of the USGA prescribe certain parameters that may not be exceeded without becoming out of regulation. As is well known, surface roughness is commonly expressed in terms of Ra as below:

$$R_a = \frac{1}{n}\sum_{i=1}^{n} |y_i|$$

where n is the number of data points across the surface and y is defined as the deviation from a mean line at that data point. Collectively, $R_a$ represents the average of deviations from a mean line over a 2-dimensional surface sample. Maximum peak-to-trough distance is measured in the 2-dimensional sample. The USGA regulations put limits on the acceptable surface roughness of the striking face of golf clubs. The USGA standards allow a surface having a value of $R_a$ no greater than 0.0046 mm (180 μin.), and a value of $R_t$ of no more than 0.025 mm (1000 μin.). Consequently, one would ideally maximize the traction between the surface textured club face with the ball getting as close as possible to the USGA rules.

U.S. Patent Application Publication No. US 2014/0135143 published on May 15, 2014 to Aguinaldo et al. of Callaway Golf Company disclosed an adjustable shaft and hosel assembly for adjusting the angle of a golf club face, its loft angle, and its lie angle. In this disclosure, a shaft sleeve having a shaft sleeve axis and a shaft receiving bore is recited wherein the shaft receiving bore has a bore axis that is coaxial with the shaft sleeve axis. Further, the hosel has a hosel bore extending from the sole to the crown, wherein at least part of the hosel bore has a diameter sized to receive at least a part of the shaft sleeve. The present invention provides a much improved adjustable shaft and hosel system wherein the varying degrees of loft and lie are perfectly adjustable in a easy fashion for anyone.

U.S. Pat. No. 8,979,670 issued Mar. 17, 2015 to Aguayo, et al. of Dunlop Sports Company discloses a golf club with a striking face including a plurality of score lines each having an average depth no less than about 0.10 mm, with a plurality of microgrooves each having an average depth no greater than about 0.010 mm and a plurality of textured surface treatment regions that intersect the microgrooves. This striking face increases traction between the striking face and a struck golf ball to impart a degree of spin to the ball, supposedly for stability in flight. In direct contradistinction, the present invention provides a surface texture for stabilizing the ball to remove spin once the ball has been struck.

U.S. Pat. No. 7,677,990 issued Mar. 16, 2010 to Ban of Bridgestone Sports Co., Ltd., discloses a golf head including a face with a plurality of milled cuts formed on the face by milling. A surface roughness is caused therein to obtain a larger spin amount of a struck ball. The pitch "P" is in a preferred direction of the plurality of milled cuts such that the golf club head is capable of obtaining a larger spin amount. The present invention includes a special surface roughness that controls spin of the ball, rather than accelerating it.

SUMMARY OF THE INVENTION

The present invention discloses a fully adjustable golf club head with various interchangeable components, making the golf club head adjustable in many aspects, including an adjustable hosel for adjusting loft and lie angles, as well as an interchangeable rear flange to adjust the bounce angle of the club. An interchangeable flight weight bar is disclosed for effecting the center of gravity, thereby also affecting the launch angle of the ball when struck. An interchangeable rear flange is provided which also adjusts the club in at least one direction by the use of offset washers to vary the placement. Said adjustment not only may be oriented up or down and side to side, but may also be diagonally oriented to affect toe down or heel up or vice versa.

In addition, the adjustable configuration of the present invention further envisions a possibility for replacement of the entire face plate, which will also have adjustment settings for interchangeability of the rear flange, flight weight bar, and hosel position and location described hereinabove.

A novel milled surface roughness pattern in the faceplate made by a novel method is also disclosed. This new design of a golf club head provides a friction milled face pattern with a multi-directional pattern creating exceptionally fine spacings for putters, wedges, irons and clubs of 25° or less, a classification by the USGA for hybrids, fairway and metal woods.

BRIEF DESCRIPTION OF THE DRAWINGS

A more complete and full understanding of the aspects and nature of the present invention will become apparent upon considering the following detailed description, when taken in connection with the accompanying drawings, wherein.

DETAILED DESCRIPTION OF THE INVENTION

Therefore, in accordance with the present invention, a new and novel adjustable golf club head is disclosed which is capable of effecting spin orientation, bounce angle, loft and lie angles, center of gravity location, and other aspects to be taken into consideration when playing the game of golf.

Figure 1:
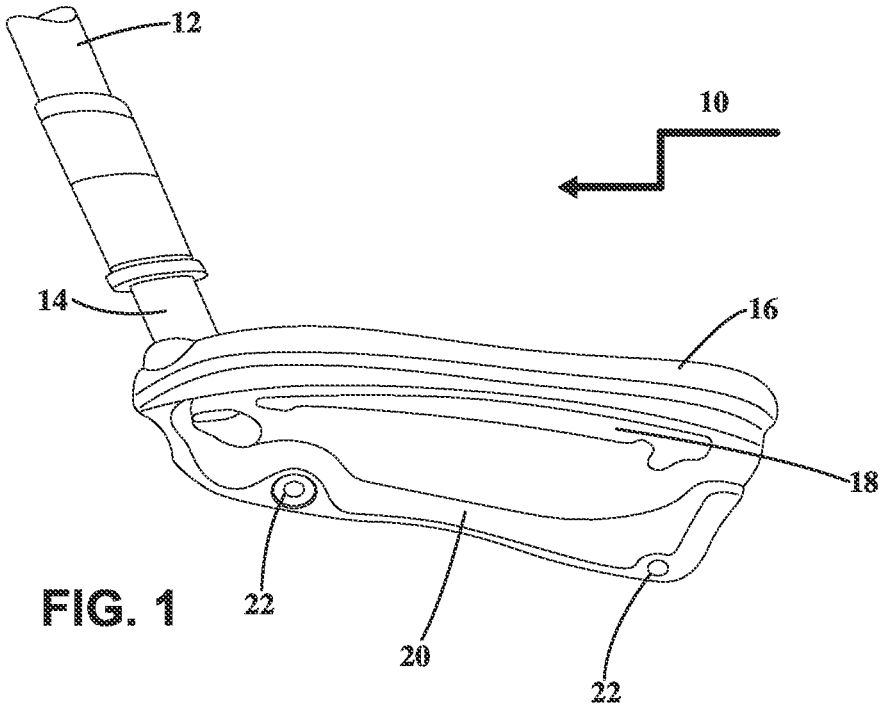
FIG. 1 is a perspective view of a golf club head made in accordance with the present invention.

Referring now to the drawings, FIG. 1 illustrates a golf club generally denoted by the numeral 10, including a golf shaft 12 terminating in an adjustable hosel 14 secured within golf club head 16. Recessed into the rear face of golf club head 16 is a flight weight bar 18 at the upper end of the golf club head 16. In order to provide for adjustability of the golf club head, an interchangeable rear flange 20 is secured to the back of the golf club head 16 by securement devices 22, especially an allen head type screw. Hosel 14 is adjustable, and will be discussed more fully hereinbelow.

Figure 2:
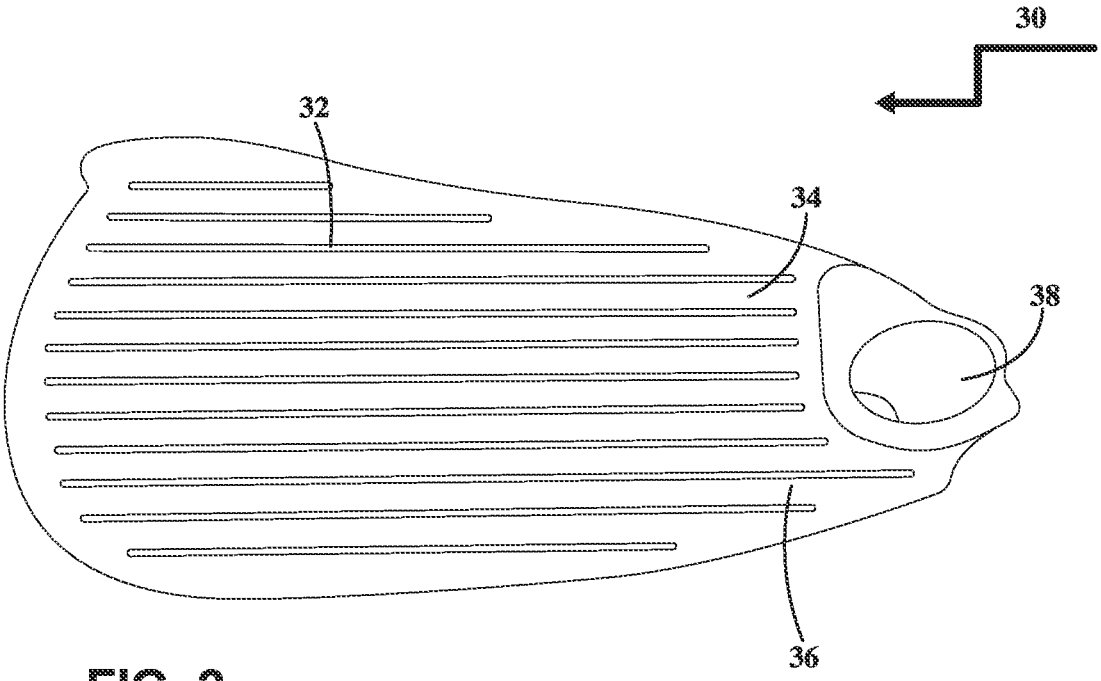
FIG. 2 illustrates a front elevational view of the milled surface roughness of the golf club head.

FIG. 2 shows the novel milled surface roughness on the faceplate, generally denoted by numeral 30, including USGA regulation grooves 32 with intersecting milled cuts 34 having a surface roughness of 180 or less micro inches. Although any surface roughness may be made in accordance with the present invention, the present invention envisions clubs to be made for all golfers, not just PGA tour players. For all the aspects of the present invention, the intersecting milled cuts form a predominantly geometric pattern across the entire surface of the faceplate, but may also only cover at least one portion of the faceplate, with differing surface roughness on other portions of the faceplate. Preferably, the pattern may be a diamond pattern, but any other pattern is also suitable. For example, a diamond pattern includes areas of intersection of cuts which makes micro spacing at the intersection, forming the proper roughness over the entire surface that is most advantageous. This surface roughness can be controlled by speed, feed, path, and depth and angle of the cut during the milling operation.

For wedges, irons and the new hybrid design of golf club disclosed herein, a preferred method of mechanically milling the faceplate is to run a $3/16^{th}$ boring bar comped on a 5° angle in a holder utilizing a 0.020" single triangular insert with a 3° radius on tip and a 5° draft angle in a CNC milling machine at a speed of 1600 rpm, with a feed rate of from 70" to 80" per minute, preferably 75" per minute. A width of each cut shall be about 0.020" on opposing 30° angles, creating a diamond pattern with from about 15 to 30 crosshatched embossed serrations within each diamond. The depth of cut ranges from 0.0005" to 0.001 inches, preferably to a depth of 0.0008 inches. For putters, where the USGA regulations vary, depth of cut can be as much as 0.040 inches.

Preferably, the amplitude of the cut will be most suitable if it is from 0.005 inches to about 0.040 inches, while the frequency of peaks is from 20 to 50 per 0.030 inches. This is measured using a surface roughness comparator or profilometer for determinations.

Surface roughness, surface texture and surface topography are all terms used to describe the nature of a surface that is usually defined by several characteristics, i.e. the first characteristic being called "roughness" which is calculated by the individual peak heights of areas above the surface plane, and secondly, the "frequency" or spacing of the individual peak heights of material. Generally, it comprises the small local deviations of a surface from the perfectly flat, ideal, true plane of the lay.

Surface texture is one of the important factors that controls friction during sliding. Sliding occurs when the golf ball rides up the surface of the golf club face during impact. The surface roughness prescribed by the use of the present invention imbues friction in order to produce back spin of the golf ball which is desirable to control ball flight. Considerable efforts have been made to study the influence of surface texture on friction and wear during sliding conditions of a golf ball during the strike. Sometimes, friction phenomena can be observed during sliding depending on surface texture.

Each manufacturing process, such as with many kinds of machining, produces a surface texture. The process is usually optimized to ensure that the resulting texture is usable. If necessary, an additional process can be added to modify the initial texture. The process may include milling, grinding, abrasive cutting, polishing, lapping, honing, discharge machining (EDM), lithography, photomicrolithography, industrial etching/chemical milling, laser texturing, or any other suitable process, whether singly or in combination.

The method of milling the faceplate design shown in FIG. 2 includes the use of a cutting tool which can perform the above described milling to a dimension of 180 or less micro inches deep, pursuant to USGA regulations, or the milling may be to any commercially desirable dimension. Although there are standard equations for determining a value of surface roughness, as described hereinabove, and usually referred to as $R_a$, those values can be expressed for both embossing as well as debossing of the surface. In this aspect of the present invention, a geometric pattern with roughened areas contained within the geometric shapes is most preferred.

The faceplate is manufactured from a metal material, including but not limited to stainless steel, coated stainless steels, carbon steel, bainite steel, martensitic steels, etched steels, and the like. The surface roughness may be manufactured by milling, or a combination of milling and etching with chemical components to provide a desired surface roughness. In order to add toughness to the surface, a coating of a plasma vapor deposition of cosmetic coatings, wear resistant and durability materials, including, but not limited to titanium, titanium dioxide, titanium carbide, silicon carbide, silicon nitride, boron carbide, or any other carburized or carbonitrided surface treatment, or combinations thereof, may be suitable for the present invention.

In the process of milling the golf club face, it is preferred to utilize a CNC milling operation for imparting a textured pattern, described hereinabove. The preferred surface roughness is created with a multi-directional diagonal pathways, making small repeating diamond-shaped outlines for the internal geometric pattern with the prescribed roughness patterns therein. The pattern shall be very finely spaced between the feed lines and mill marks, these terms being used in their conventional sense. This fine spacing allows for the proper vertical friction without any offshooting when contacted with the dimpled surface of the golf ball.

In the preferred milling operation, additional surface roughness is created by embossing rather than debossing procedures. Embossing can create a slightly raised surface because the milling operation pushes some of the material upward slightly. Debossing removes material and creates an indented profile as it engraves below the surface. Although the embossing effect is slight, it is sufficient to add surface roughness to a desired level. The embossing technique will relate to a topical application on the surface, thereby creating the desired amount of friction and surface roughness. As can be imagined, the surface roughness and texture pattern can be applied to all fourteen (14) club faces in the bag. Multiple possible texturing patterns may be cut into the toe, center and heel section of club faces, generally on those of 25° or less. For such clubs, separate patterns, as well as with separate spacing, size and depth of the texture will achieve different results for enhanced ball flight launch and spin characteristics. The face milling texture may be applied differently on different clubs, whether the club has 25° or less loft, an iron or a putter. The face milling texture produces optimized results for ascending or descending swing arc's, due to the fine milled spacing and resulting patterns.

Individual milled cuts and milling patterns may create individual roughness peaks and valleys having aspect ratios of from 1 to about 5000. These roughness peaks and valleys 36 must fall within USGA guidelines for roughness. This roughness is thought to create surface friction that when striking the ball, back spin is created, thereby providing more control over the distance and direction once the ball has launched.

Figure 3:
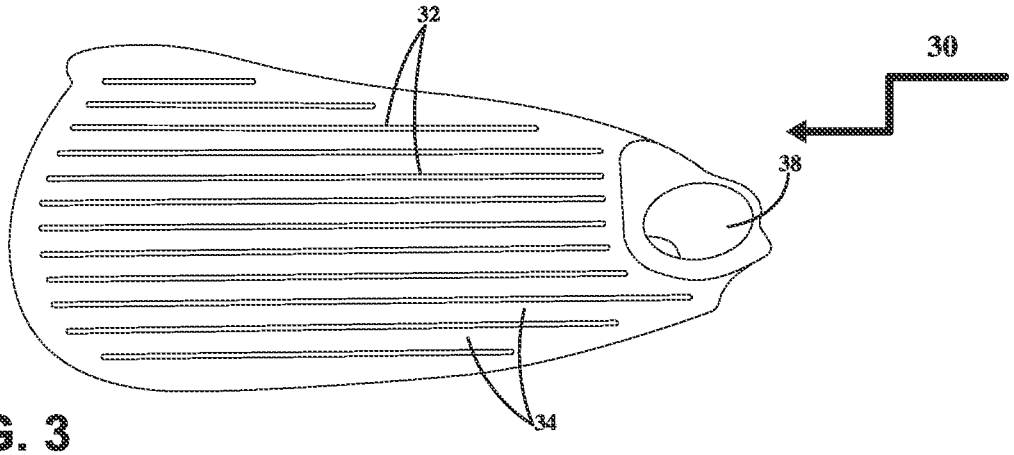
FIG. 3 again illustrates a front elevational view of the milled surface roughness of the golf club head in a three-dimensional blueprint format.

FIG. 3 is a 3-dimensional blueprint drawing of the golf club head of FIG. 2 more closely revealing the machine cut pattern on the faceplate, including the geometric pattern, preferably including diamond shaped cuts 34 which are predominantly from 20° to about 45°, and preferably 30° angle cuts from a 90° vertical baseline y-axis, coming in from either direction. The intersecting milled cuts 32 and surface roughness provide the preferred roughness pattern for the present invention. This intersecting mesh pattern provides superior friction for ball spin characteristics. These cuts are milled with opposing diagonal angles. In practice, the diagonal cuts are first made in one direction, followed by a second cutting in the second direction, thereby forming intersecting diagonal cuts. Peaks formed by cutting create more contact points across the surface, and this creates more surface roughness, which means better adhesion with a golf ball cover. Upon striking the golf ball, less sliding of the ball up the club face is encountered. By reducing sliding of the ball up the club face, spin rate is increased. The spin rate of a golf ball may be increased or decreased by adjusting the ratio of various parameters of the milling process, including feed rate, spin rate, style of cutter, depth of cut and angle of cut.

Still looking at FIG. 3, hosel ball socket 38 is shown as being smooth for easy adjustment and including a pair of locator pins (not shown) for locating adjustable hosel bore holes on corresponding compound angles as predetermined by the golf club owner and his desired degree of adjustment.

Figure 4:
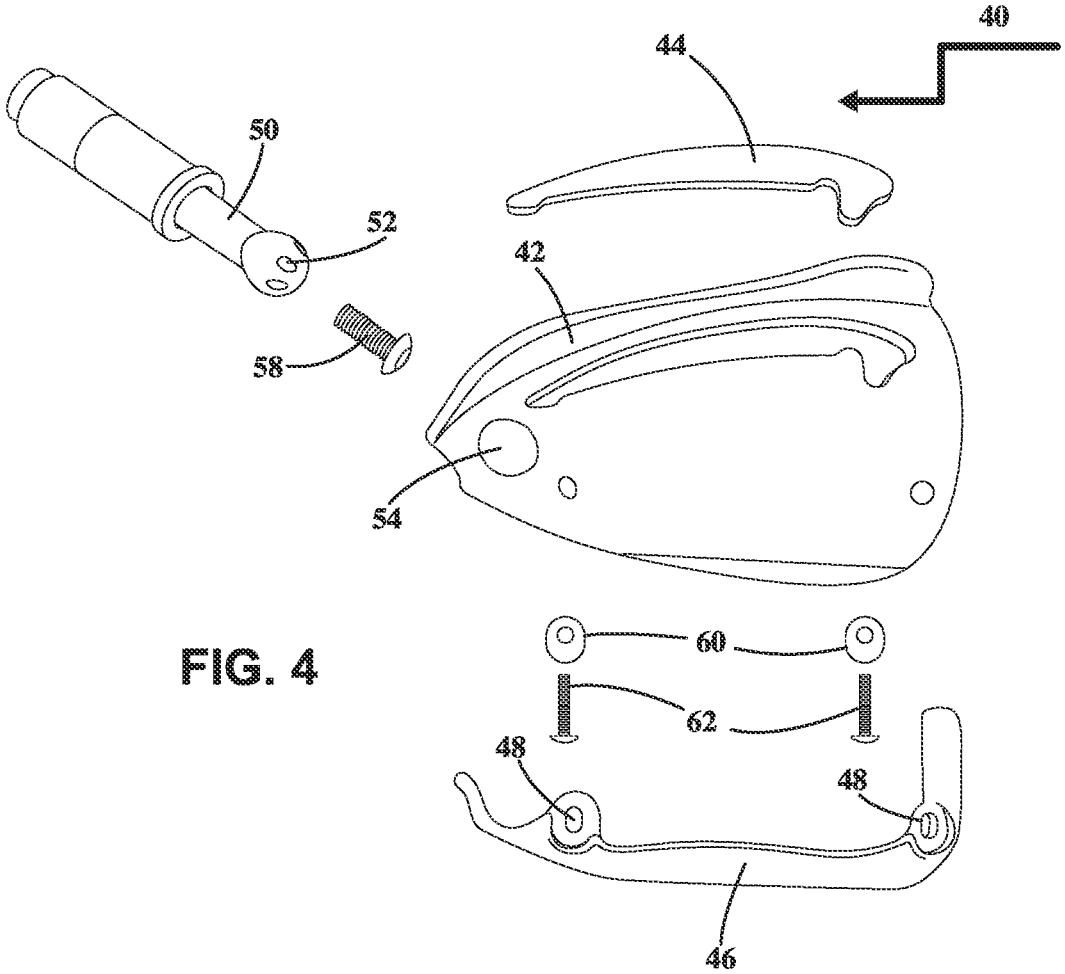
FIG. 4 is an exploded view of the various components of the golf club head.

FIG. 4 is an exploded perspective view of the adjustable golf club head of the present invention with most of the components shown in their relative placement prior to assembly. In that regard, adjustable golf club head generally denoted by numeral 40 includes golf club head 42 and flight weight bar 44 to be received within a recess in the rear face of the club 42. Interchangeable rear flange 46 includes recessed openings 48 at either end to be secured to golf club head 42 by securement devices 62 through offset washers 60. The front opening of hosel socket 54 is sized to receive hosel ball 52 at the distal end of hosel shaft 50 and is secured thereto by securement device 58. Securement device 58 is preferably a left hand threaded screw with a convex shaped backside of the screw head. Therefore, securement device 58 can slightly travel within the concave surface of the backside of the hosel socket 54 due to the convex shape of the screw head backside. The feature of utilization of a left hand threaded screw allows for continuous tightening upon swinging the golf club and striking the ball. Securement device 58 is to be made of a sufficiently strong and rigid material such that it will carry the load, while being stabilized by the locator pins. Recess 82 includes a tight machined in tolerance to minimize and limit play for a more sure feel of the golf club overall.

Although any suitable material may be used for any of the abovementioned golf club components, the preferred material for the faceplate is 303 stainless steel, while 7075 aerospace aluminum is preferred for the hosel. Again, 7075 aerospace aluminum works well for the hosel trim piece (not shown), with a copper-tungsten blend metal material being preferred for the flight weight bar. Stainless steel is preferred for the rear flange, the hosel position screw, the flange position screws, the offset washers and the loft position pins. A polyurethane O-ring on the hosel helps to provide a cushion for compression fitting of the neck piece, as well as a seal to preclude the elements.

Figure 5A:
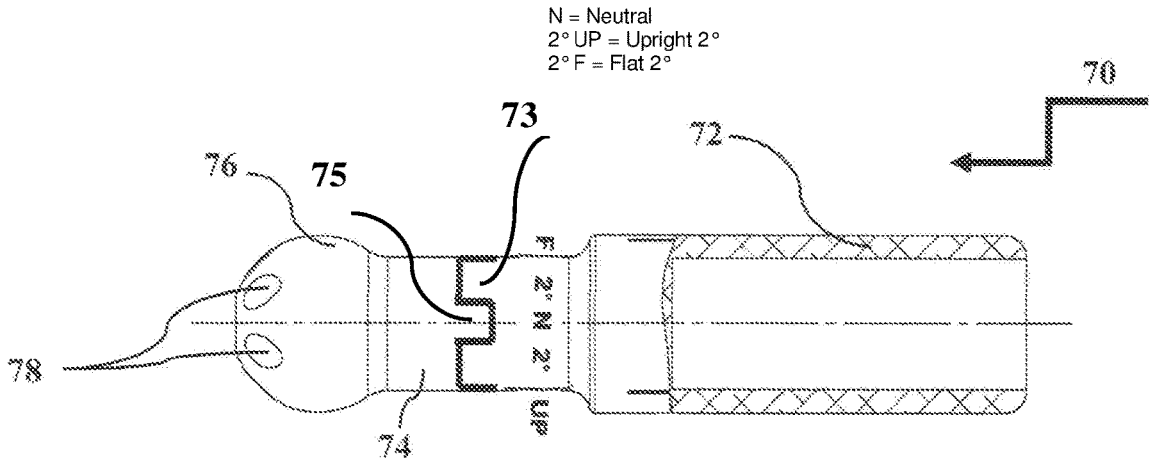
FIG. 5A is a side elevational view of an adjustable hosel made in accordance with the present invention.

FIG. 5A shows the entire adjustable hosel as being generally denoted by numeral 70 including a knurled fingerhold 72 for rotating hosel shaft 74 to bring hosel ball 76 into proper location against locator pins (not shown here) into locator pin recesses 78 on a compound angle. Although difficult to see in this figure, the compound angle of the locator pin recesses 78 is magnified at the gripping end of the shaft, as the arcuate angle distance becomes greater the further one goes away from the hosel ball. For example, a one degree (1°) change of the compound angle of the locator pin recesses 78 within the hosel ball can translate to a few inches at the end of the shaft, depending on the length of the shaft. The strength of the hosel is created by both of the location pins and the hosel screw. In further aspects of the present invention disclosed hereinbelow, a single piece machined hosel and neck collar trim piece will be described in greater detail.

In another aspect of the hosel ball adjustment shaft 74, it may be composed of two separate mating hosel shaft pieces with mating notches, male notches 73 and female notches 75 cut therein. These two hosel shaft pieces, when assembled, will align the hosel ball shaft 74 into different angles to provide varying lie angles. As can be seen in FIG. 5A, notches 73 and 75 may be cut at a slight angle such that when the shaft 74 is separated into two (2) mating parts, rotated and then reassembled into a unitary shaft, a new lie angle is determined for the golf club. Preferably, the male and female notches can be notched in two (2) degree increments, slightly shifting the lie angle at the hosel, yet translating into a significant arcuate angle deviation at the golf club grip end. In this aspect, it is envisioned that the two degree increments shown in FIG. 5A may shift from neutral, which is generally considered to be 64°, to an upright position by shifting the hosel shaft 74 components 2°, or to a flat position by shifting the hosel shaft 74 components 2° in the other direction. Of course, these adjustments are merely illustrative, and it shall be known that any suitable notch orientation other than 2° can be used to achieve any lie angle desired.

In addition, a traditional one piece sand wedge has approximately 70 grams of weight in the hosel portion of the club head, whereas the present invention eliminates about 60 grams of weight as the present hosel construction is much lower in weight, i.e. about 12 grams of weight. This allows for a better weight distribution throughout the club head such that the center of gravity is now more true in a centered position on the club face since the weight is not up on the hosel portion, but rather on the club head. This may provide better distribution of the club head weighting.

Figure 5B:
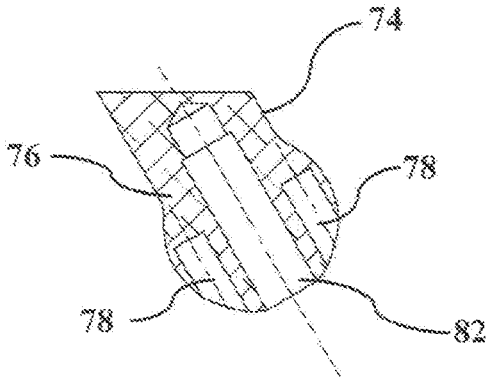
FIG. 5B is a cutaway view of the interior portion of the adjustable hosel.

FIG. 5B is a cutaway view of the interior of hosel ball 76 with locator pin recesses 78 shown therein. The locator pin recesses 78 are drilled into the hosel ball 76 at corresponding compound angles with respect to a longitudinal axis defined by recess 82. Locator pin recesses 78 are preferably angled in the same direction so that they may easily be fit over locator pins (not shown here) to achieve the desired club face loft setting. Hosel shaft 74 terminates in hosel ball 76 and has running therethrough a recess 82 to receive the hosel ball securement.

Figure 5C:
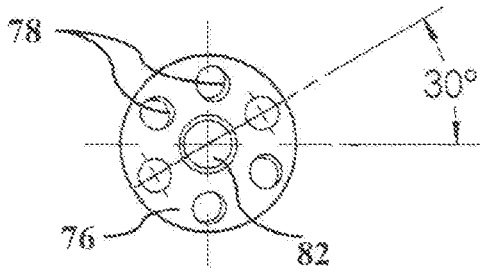
FIG. 5C is a bottom plan view.

FIG. 5C is a bottom plan view of the hosel ball 76 showing the relative placement of locator pin recesses 78 and hosel ball securement recess 82 for determining adjustments to both the club face loft and lie angles. In this example, locator pin recesses 78 are 60° apart from one another because there are three (3) adjustments shown. However, in accordance with present invention, any club face loft angle can be adjusted by a change in the corresponding compound angles of the locator pin recesses 78 to achieve a desired club face loft angle. This change may be in one degree increments from 0° to 62°. Furthermore, the lie angle can also be adjusted by changing the corresponding compound angles of the locator pin recesses 78, also by one degree increments. Rotation of the hosel ball 76 within its socket effectively can simultaneously change both the loft and lie angles, based on the compound angle of the corresponding locator pin recesses. As one can note, rotating the hosel ball 76 will orient both the club face loft angle as well as the lie angle. Moreover, in other aspects, the current configuration may be adapted to allow independent adjustments of both the loft and lie angles, depending upon the compound angle drilled for the locator pin recesses. The number of, and positioning of, location pins determine those angles. Therefore, desired adjustments in the loft and lie angles may be achieved by the use of a single hosel ball and hosel socket features. This novel singular ball and socket feature of the present invention can determine dependent as well as independent adjustment to loft and lie angles based on the number and orientation of corresponding compound angle recesses with their number and location of the complementary location pins.

Figure 5D:
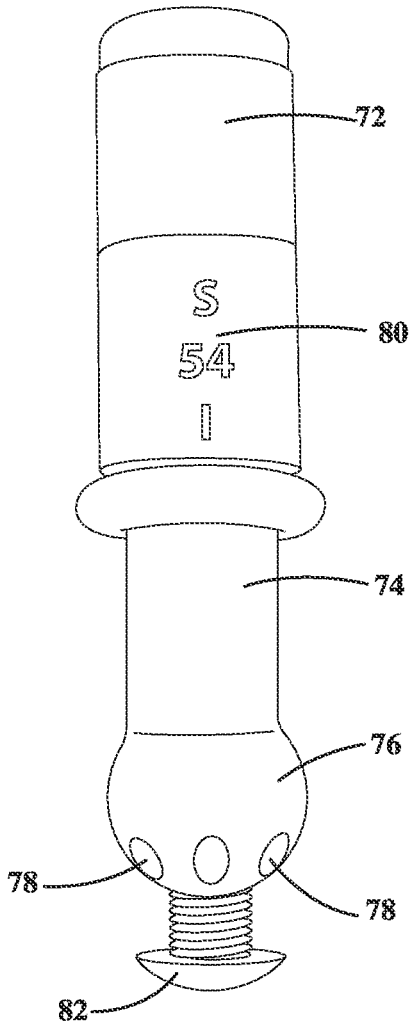
FIG. 5D is a side elevational view showing the angle indicia.
Figure 5E:
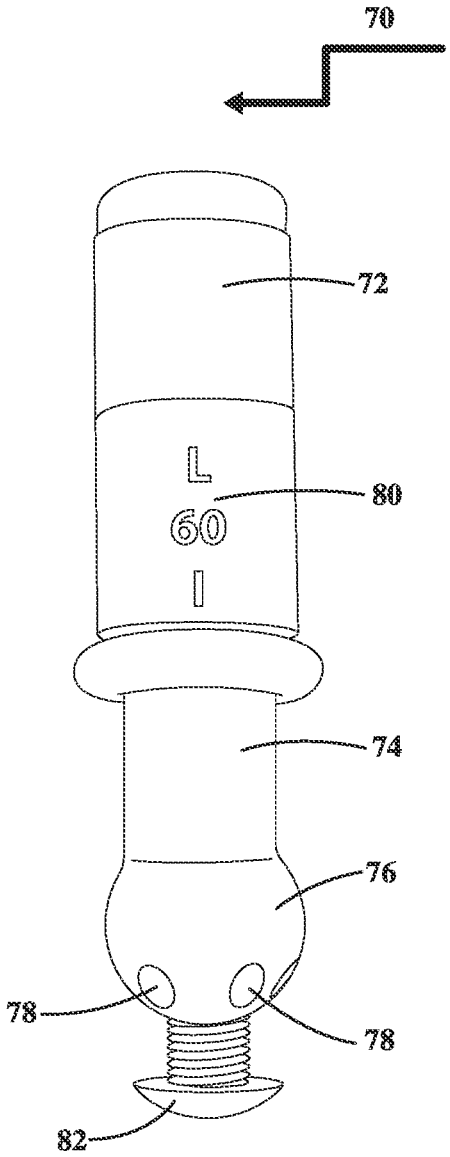
FIG. 5E is a side elevational view showing the angle indicia.
Figure 6A:
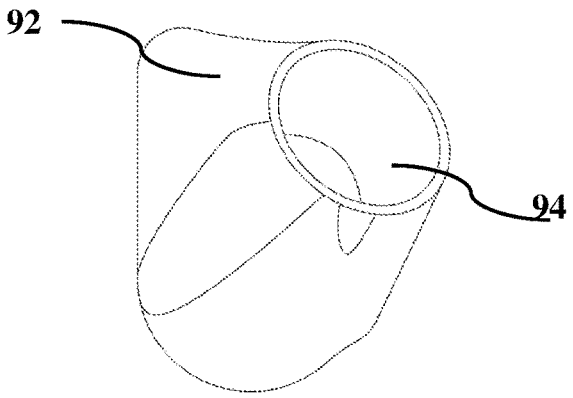
FIG. 6A is a side perspective view of a neck trim piece for covering the adjustable hosel.
Figure 6B:
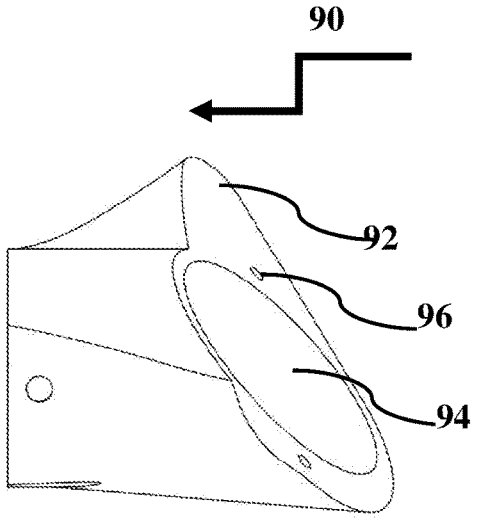
FIG. 6B is a side bottom perspective view.
Figure 6C:
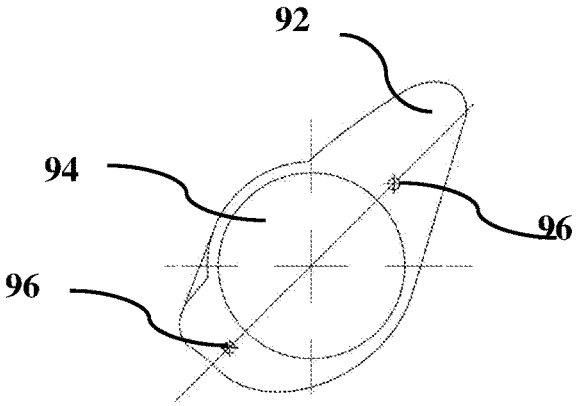
FIG. 6C is a bottom plan view.
Figure 6D:
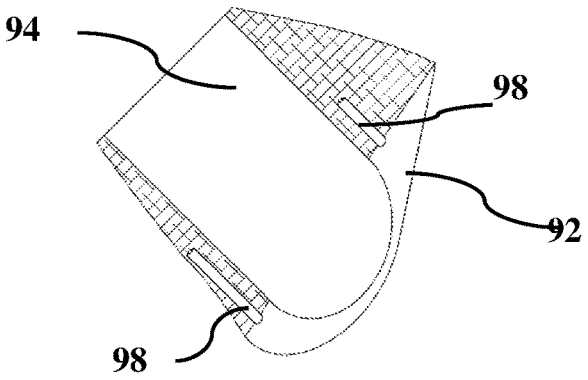
FIG. 6D is a side cutaway view showing hosel receiver.

With combined reference to FIGS. 5D and 5E, shown is an adjustable hosel 70 having a knurled fingerhold 72 with a hosel shaft 74 terminating in a hosel ball 76 with locator pin recesses 78 at the terminal end. In another aspect of the present invention, knurled fingerhold may include a grooved fingerhold surface wherein the outer diameter of the grooves are the same as the inside diameter of the neck trim piece, such that the fingerhold will permit ease of sliding therethrough. Angle degree indicia 80 is indicated by various initials, "S" at 54°, and "L" at 60°. This indicates relative club face loft angles corresponding to "S" sand wedge and "L" lob wedge, respectively. Other angles are determined by varying orientations by one degree increments to determine varying club face loft angles. As described above with reference to FIG. 5C, lie angles are also adjustable With combined references to FIGS. 6A, 6B, 6C, and 6D there is shown a neck trim piece 90 having a neck collar 92 for surrounding hosel 70 (as shown in FIGS. 1-5E). Neck collar 92 defines an opening 94 through which the hosel is inserted. The neck collar 92 is used to trim the adjustable hosel for aesthetic purposes as well as keeping the elements out. Neck trim piece 90 may be secured in any fashion, whether adhesively secured or fashioned with a compression fit, or any other suitable means for fastening. In one aspect, neck trim piece 90 may be secured by some locator means 96, such as locator pins to be received within recesses 98 which may also be used to receive any type of securement device such as a screw or the like.

Figure 7:
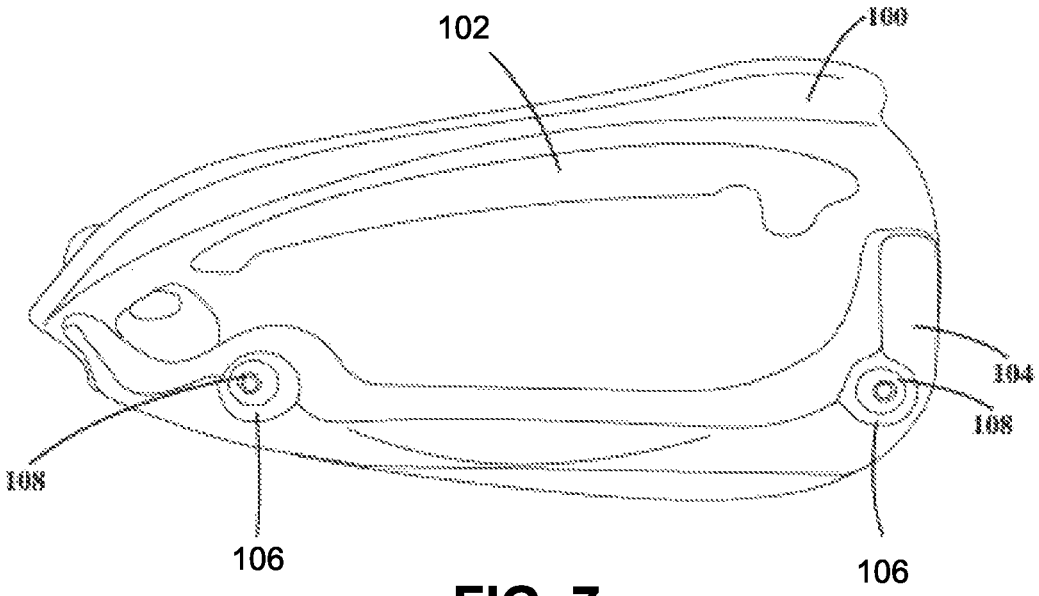
FIG. 7 is a side elevational view of the rear of the faceplate.

FIG. 7 shows a golf club head generally denoted by numeral 100 including a recessed area 102 for receiving an interchangeable flight weight bar (not shown) as described with reference to FIGS. 8A and 8B below. Another aspect of the present invention includes an interchangeable rear flange 104 with offset location washers 106 secured by offset washer securements 108. In this diagram, rear flange 104 is shown with the offset washers in the down position, as more fully described hereinbelow with reference to FIGS. 9A through 10B.

Figure 8A:
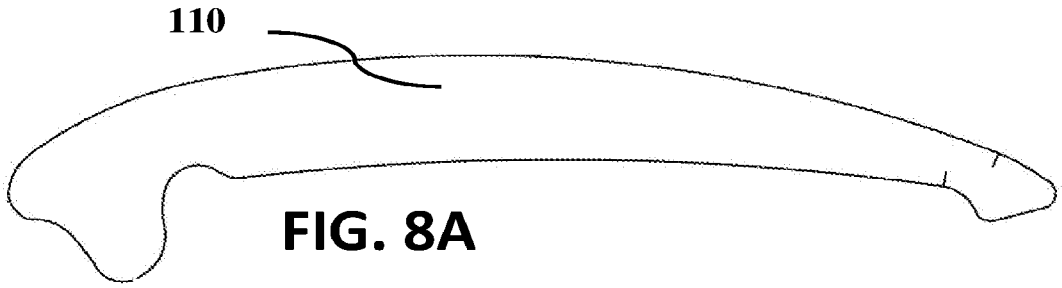
FIG. 8A is a top plan view of the flight weight bar.
Figure 8B:
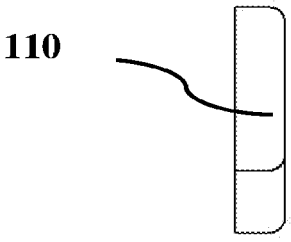
FIG. 8B is a side elevational view of the flight weight bar.

Looking next to FIGS. 8A and 8B, there is shown an interchangeable flight weight bar 110 in a front elevational configuration, and FIG. 8B shows such an interchangeable flight weight bar 110 from the front. By interchanging flight weight bar 110 with a flight bar utilizing various thicknesses and material densities of the flight weight bar, one is able to adjust the overall club head weight, by either removing the weight or adding additional weight of the existing flight weight bar. For example, to adjust the weight, a golfer can either remove the weight bar, can use a weight bar made of a low weight material, such as aluminum, or may increase the weight of the club by using a stainless steel weight bar. By using the different thicknesses or material weights in this flight weight bar, one can also change the center of gravity. This ability to raise or lower the center of gravity by either adding or subtracting weight in this location affects ball flight.

Figure 9A:
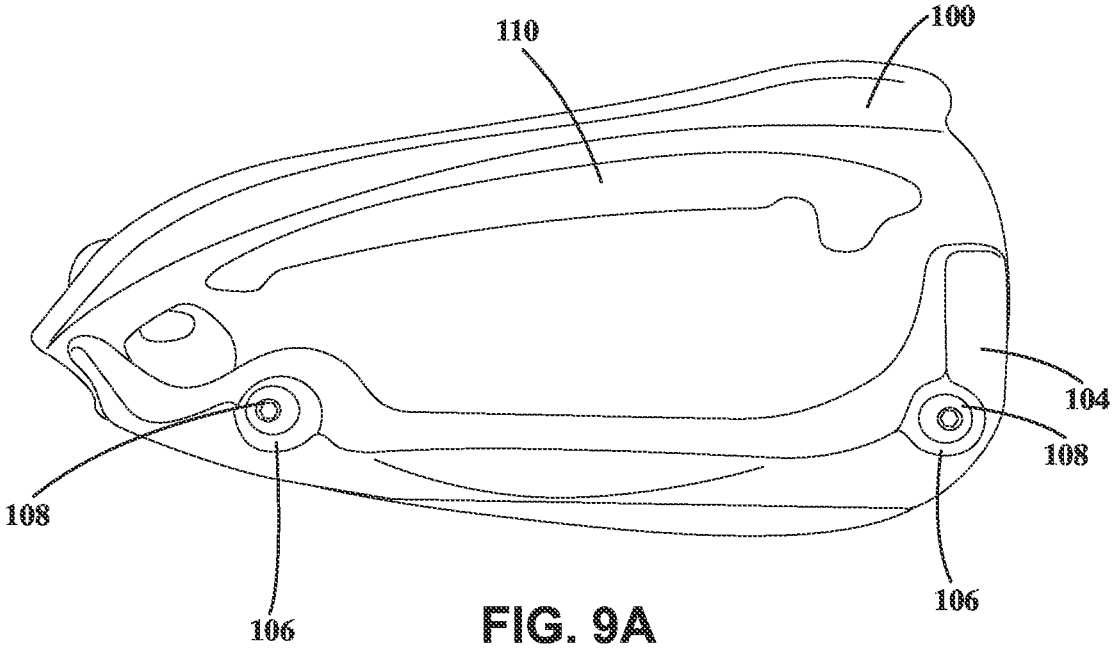
FIG. 9A is a rear elevational view of the golf club head with the interchangeable rear flange in the down position made in accordance with the present invention.
Figure 9B:
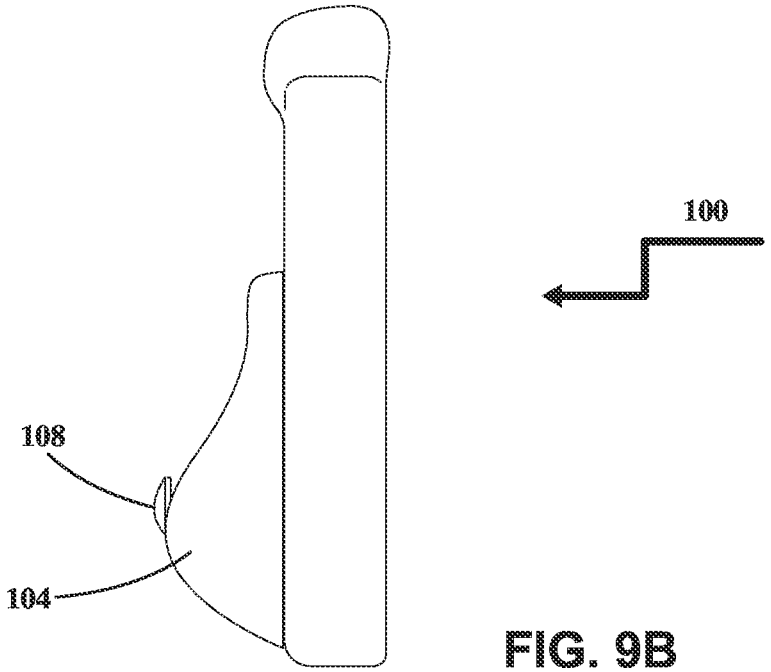
FIG. 9B is a side elevational view of the golf club head with the interchangeable rear flange in the down position.

FIG. 9A shows the golf club head 100 with the flight weight bar 110 in place within a recess shaped to receive the flight weight bar 110. Interchangeable rear flange 104 is shown with adjustable offset washers 106 in the down position such that rear flange 104 has its lower edge down against the sole of golf club head 100. FIG. 9B is a front elevational view of the golf club head 100 with the interchangeable rear flange 104 secured in the down position, wherein the leading edge of the backside of the rear flange is flush with the trailing edge of the sole of the face plate. Securement device 108 holds rear flange 104 tightly against the golf club head 100.

Regarding the interchangeable rear flange, this innovation provides the ability to modify the bounce angle of the club head upon swinging the club. This feature is significant to the purpose of the present invention. This interchangeable rear flange enables bounce adjustment. By moving interchangeable rear flange on the backside of the club head to various locations, bounce angle will be effected. By positioning the rear flange a bit lower on the backside of the club head, the rear flange will increase the bounce angle. Conversely, by positioning the rear flange a bit higher on the backside of the club head, the bounce angle will be less.

Figure 10A:
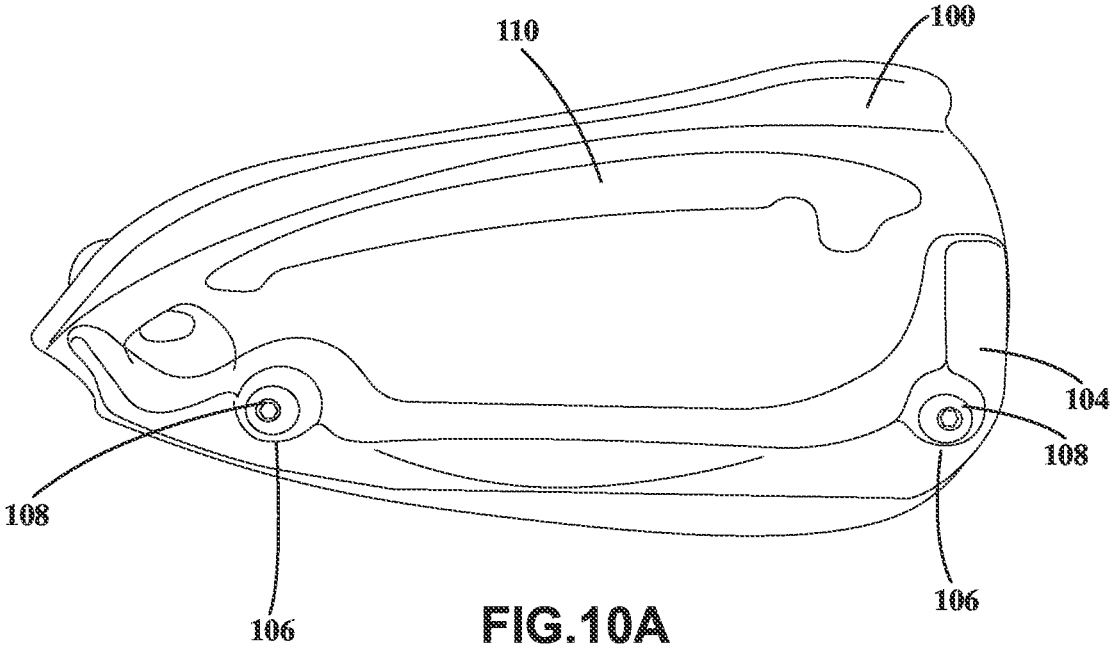
FIG. 10A is a rear elevational view of the golf club head with the interchangeable rear flange in the up position.
Figure 10B:
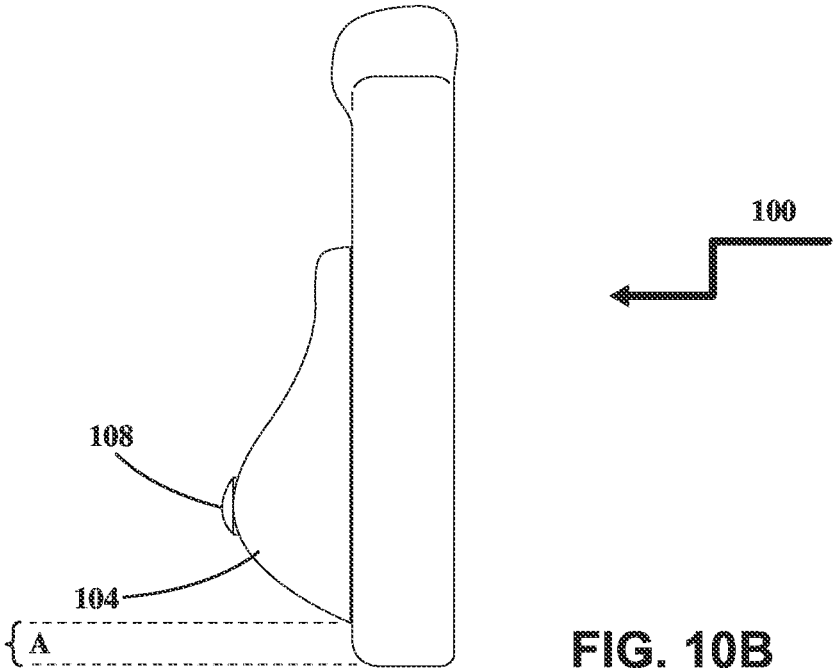
FIG. 10B is a side elevational view of the golf club head with the interchangeable rear flange in the up position.

In another aspect of the present invention, FIG. 10A shows the golf club head 100, again with flight weight bar 110 received within its complementary recess, while interchangeable rear flange 104 is now in the up position, because offset location offset washers 106 have been reversed from the original orientation shown in FIGS. 9A and 9B. Securement devices 108 hold the rear flange 104 in a position upwardly from the bottom of the golf club head 100, as can be seen in FIG. 10B. Golf club head 100 has the interchangeable rear flange 104 secured thereto by securement device 108 and it is in the up position. Notice the difference in height "A" between the interchangeable rear flange 104 and the bottom of golf club head 100. In this position, the bounce angle has been effectively lowered.

The present invention also envisions the optional use of a thin elastomeric membrane for placement between the interchangeable rear flange and the club faceplate in order to give more vibration dampening. Vibration dampening is desirable for reduced vibration and improved feel of the club overall.

Figure 11A:
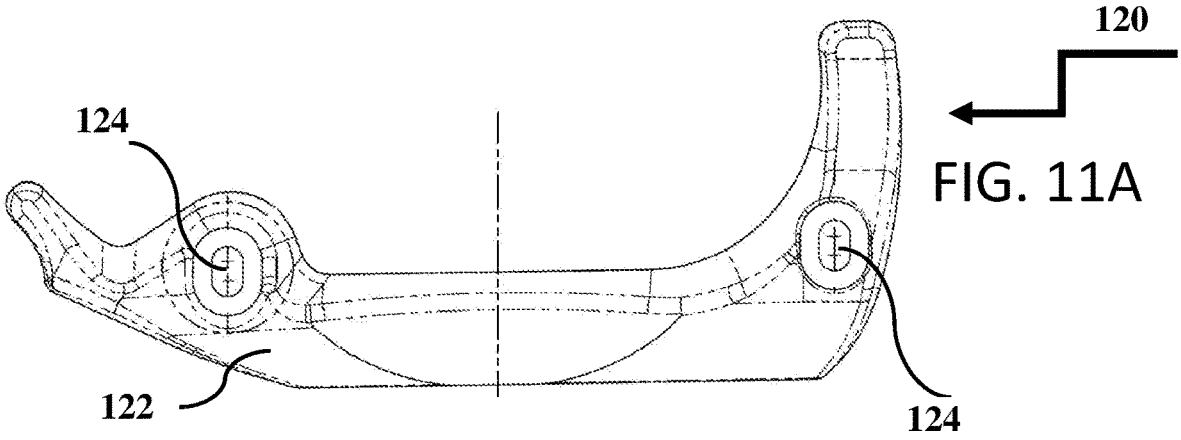
FIG. 11A is a front elevational view of the interchangeable rear flange.
Figure 11B:
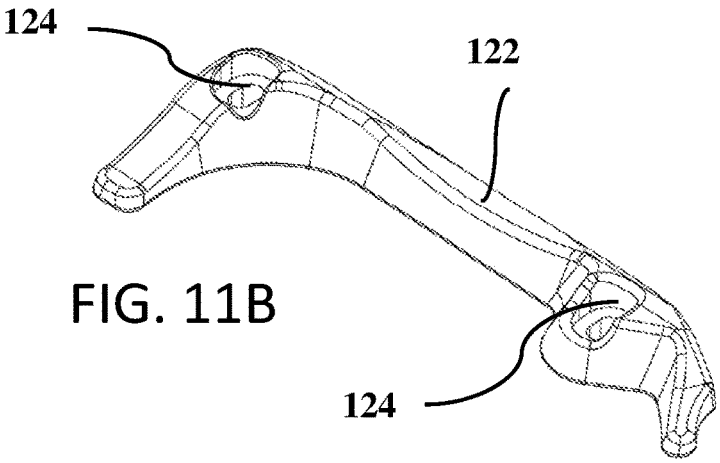
FIG. 11B is a top perspective view of the interchangeable rear flange.
Figure 11C:
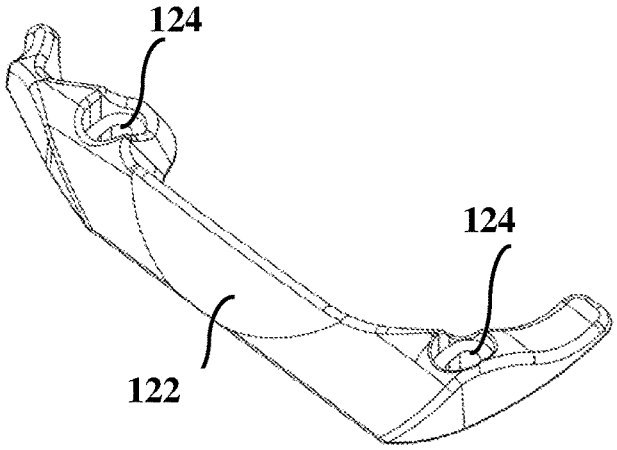
FIG. 11C is a front perspective view of the interchangeable rear flange.

With combined reference to FIGS. 11A through 11C, the interchangeable rear flange generally denoted by numeral 120 includes rear flange 122 with offset washer recess 124. As can be seen especially well in FIG. 11C, offset washer recess 124 can hold the adjustable offset washer in at least two different positions. It is envisioned by the present inventor that the adjustable offset washer can be oriented in many different directions, not just the up and down position shown in FIGS. 11A through 11C. The present invention will also include yet another aspect within its scope of a three-directional offset washer, a four-directional offset washer, and even possibly an infinitely variable adjustment offset washer (not shown here). These various aspects can be reproduced without undue experimentation, as they are commercially available.

Figure 11D:
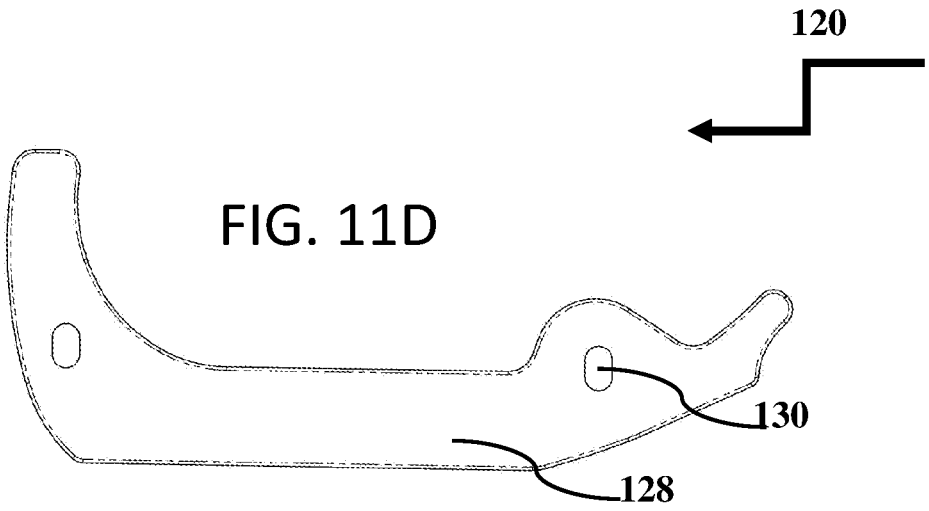
FIG. 11D is a rear elevational view of the interchangeable rear flange.
Figure 11E:
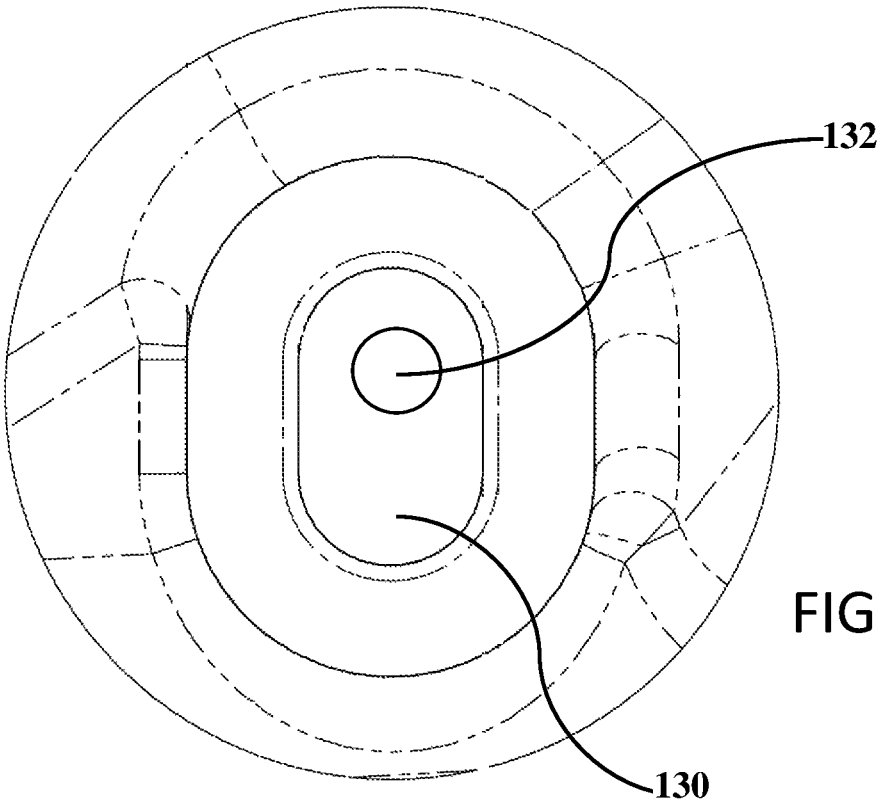
FIG. 11E is a detailed diagram of the adjustable receiver 130 of FIG. 11D.

FIG. 11D shows a rear elevational view of interchangeable rear flange 120 having a rear facing flat surface 128. Adjustable offset washer 130 is shown in place within interchangeable rear flange 120 in the position that urges the lower edge of rear flange 120 downwardly with respect to the bottom sole of the golf club head shown in earlier figures. FIG. 11E shows offset washer 130 in greater detail. One must note that since offset washer 130 is removable it can be flipped so that the offset washer hole 132 can either be in the up position or the down position. Depending upon whether or not the offset washer is in the up or down position, the relative location of the interchangeable rear flange 120 is dictated. As disclosed above, bounce angle of the golf club head is modified depending on the location of the rear flange.

Figure 12:
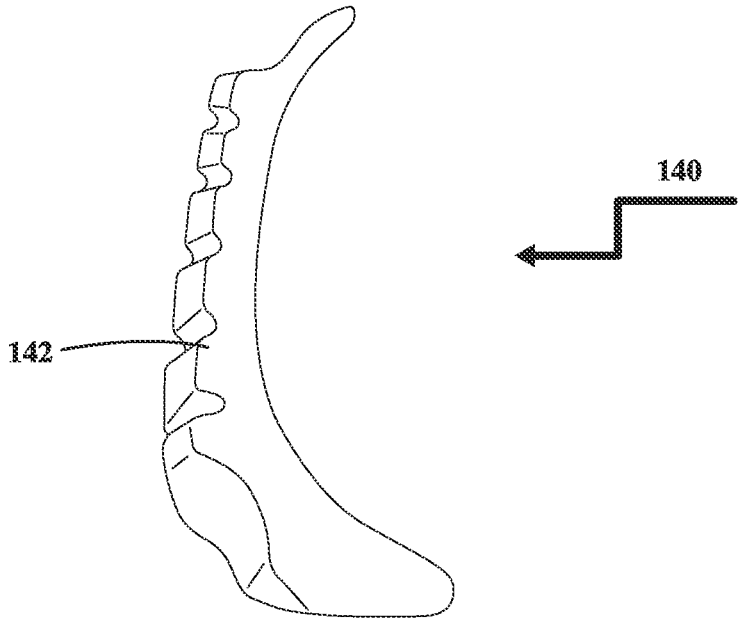
FIG. 12 is another aspect of the interchangeable rear flange with the club head.
Figure 13:
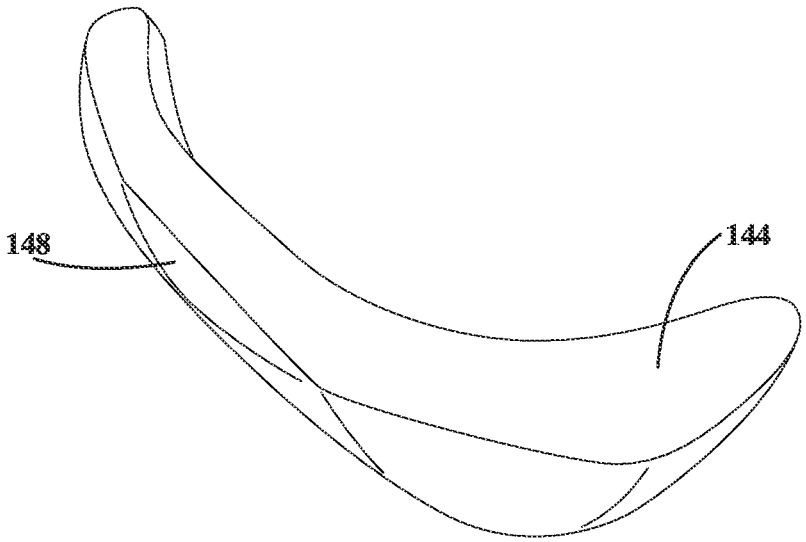
FIG. 13 is yet another aspect of the interchangeable rear flange.

FIG. 12 illustrates yet another aspect of the present invention, wherein the interchangeable rear flange may take on different characteristics including size, shape, width and/or weight to accommodate varying course conditions and/or a player's personal swing principles and preferences. In this FIG. 12, the example shown generally as numeral 140, includes a wider sole with channeled grooves 142. Yet a further aspect of the present invention, is shown in FIG. 13, wherein interchangeable rear flange 144 includes a bottom surface 148 which shows a thinner sole profile with increased heel and toe relief areas 148. By increasing heel and toe relief areas and thinning the sole profile, these features are more accommodating to general use and tighter lie conditions. The three rear flange configurations shown in the FIG.'S are not limited, but rather are illustrative of the various aspects of the invention, and the scope of the present invention shall not be so limited.

Figure 14A:
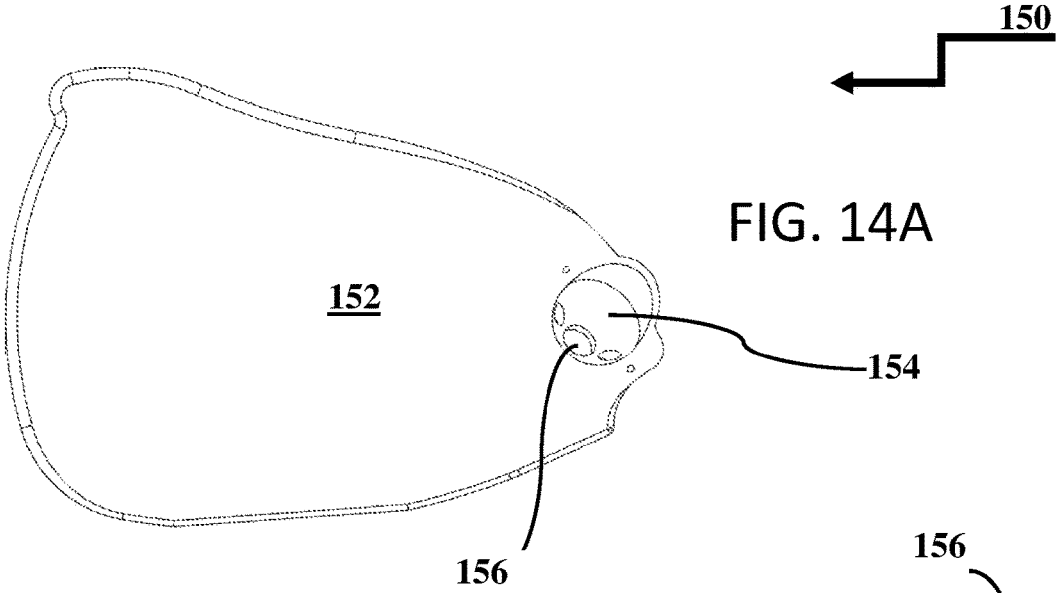
FIG. 14A is a diagrammatic representation of an interchangeable faceplate shown from the front surface.
Figure 14B:
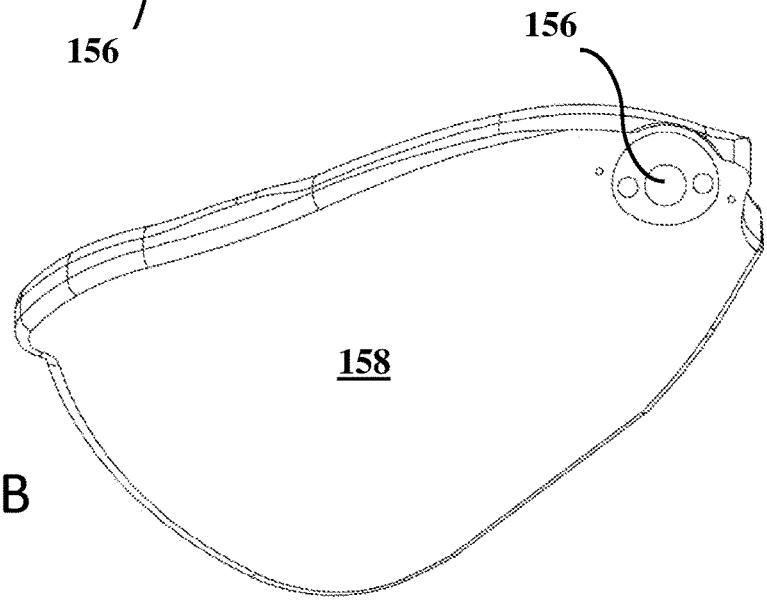
FIG. 14B is a diagrammatic representation of an interchangeable faceplate shown from the rear surface.
Figure 14C:
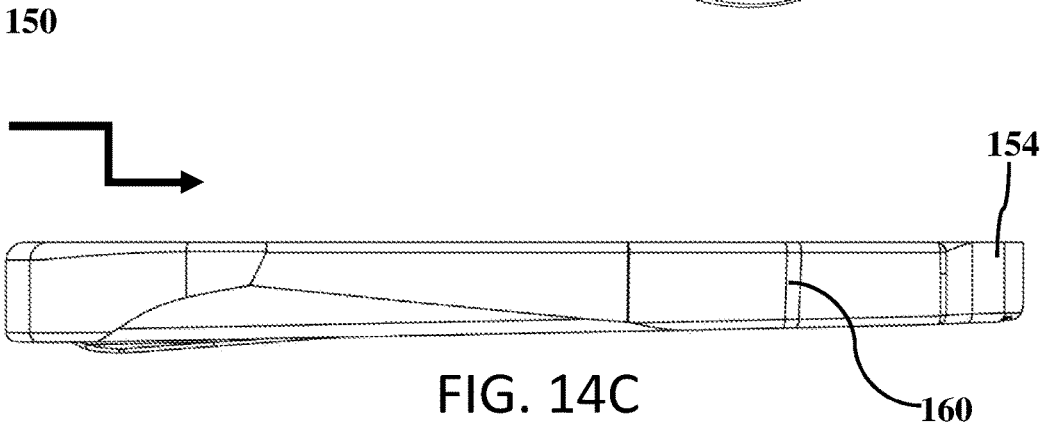
FIG. 14C is a side elevational view of the interchangeable faceplate showing the leading edge of the bottom of the faceplate.

FIGS. 14A through 14C collectively illustrate yet another aspect of the present invention of an interchangeable or replaceable faceplate for receiving all replaceable components, including the flight weight bars, the interchangeable rear flanges, or any other adjustments made by the owner. The replaceable faceplate can act as a platform onto which some or all of the interchangeable features of the present invention can be applied. In other words, this replaceable faceplate is adapted for receiving each of the interchangeable components. In the event that the faceplate becomes damaged or the roughness on the faceplate finally wears out, the faceplate can simply be replaced. Since the interchangeable components are less likely to wear out before the roughness eventually becomes smooth, the faceplate can be replaced and the interchangeable components are then merely re-assembled on the new faceplate. In FIGS. 14A through 14C, the faceplate is generally denoted by numeral 150 and includes a textured face surface 152 and a hosel ball socket 154 with a hosel ball socket securement opening 156. FIG. 14B illustrates the reverse, or rear-side 158 of golf club head 150, wherein the hosel securement opening 156 is more clearly seen. Looking lastly to FIG. 14C, a bottom elevational view of the interchangeable faceplate 150 has hosel socket 154 and rear flange securement receiver 160 therethrough. Although a single profile aspect of the replaceable faceplate 152 is shown, it is envisioned by the present inventor that any shape of the faceplate, whether larger, smaller, lighter or heavier, can be utilized.

Within the scope of this invention, and due to the interchangeable components, any faceplate may include different heights, lengths, and toe/heel/sole profiles. Also, personal preferences for weight, weight distribution and other personal preferences are achievable, including club head center of gravity. Furthermore, replaceable faceplates with varying hosel ball socket locations on the face plate can be purchased for personal preference. In the FIG.'S above, the hosel ball socket location is shown relatively higher on the club face, although the hosel ball socket may be located lower on the club face, near the leading edge. Another effect of the present invention includes the fact that the lack of a conventional integral neck piece allows for replacement of only the faceplate. Prior art clubs have the hosel as an integral part of the faceplate. Conventional club faceplates would not generally be able to be replaced while maintaining the adjustable features of the present invention. Because of the lack of an integral hosel, the manufacturing of the faceplate provides a planar surface, substantially without traditional "dishing" milling effect, which provides a true advantage during the milling process. This advantages comes about because the machinists now have a fully accessible planar surface, which means they can provide surface roughness across the entire surface, without regard to sidestepping the hosel.

Figure 15:
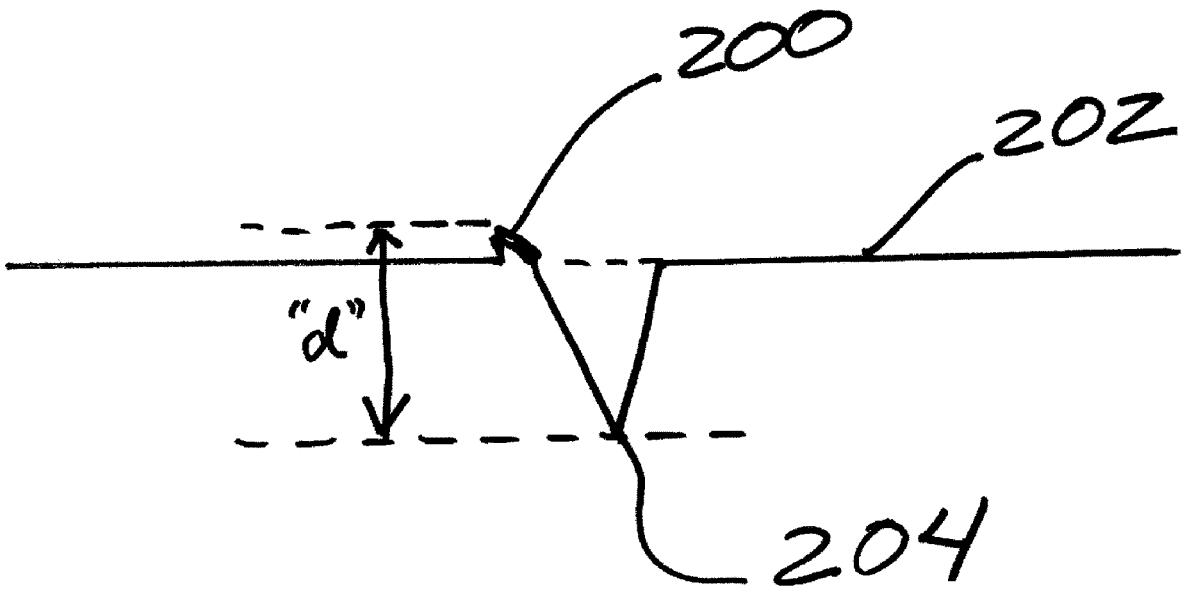
FIG. 15 is a side elevational view of the milled cuts made with embossing.

FIG. 15 is a side elevational view of the milled cuts made with embossing yielding a total cut depth of less than 180 micro inches in compliance with USGA regulations, where the total depth cut "d", includes the embossing portion 200 above the faceplate surface plane 202. Embossing 200 occurs when a fast cutting feed rate is combined with a slower spindle speed during the cutting/milling operation pushing some of the surface plate material upwardly above the surface plane. Prior art teaches slower feed rates with high spindle speeds, where the surface plate material is carried away, so that their entire depth of cut ("d") is below the surface plane. In the present invention, while at the higher cutting speeds described above with reference to FIG. 2, embossing does occur, providing additional roughness to help control more surface roughness. In this aspect, the total depth of the cut, from the upper tip of the embossing 200 down to the bottom of valley 204, maintains the "less than 180 micro inches" of the USGA regulations, while adding additional roughness. In other words, some of the depth of cut is above the surface plane, while a shorter depth is below the surface plane. Prior art milling operations do not provide embossing adding any additional height above the surface plane of the faceplate.

Figure 16A:
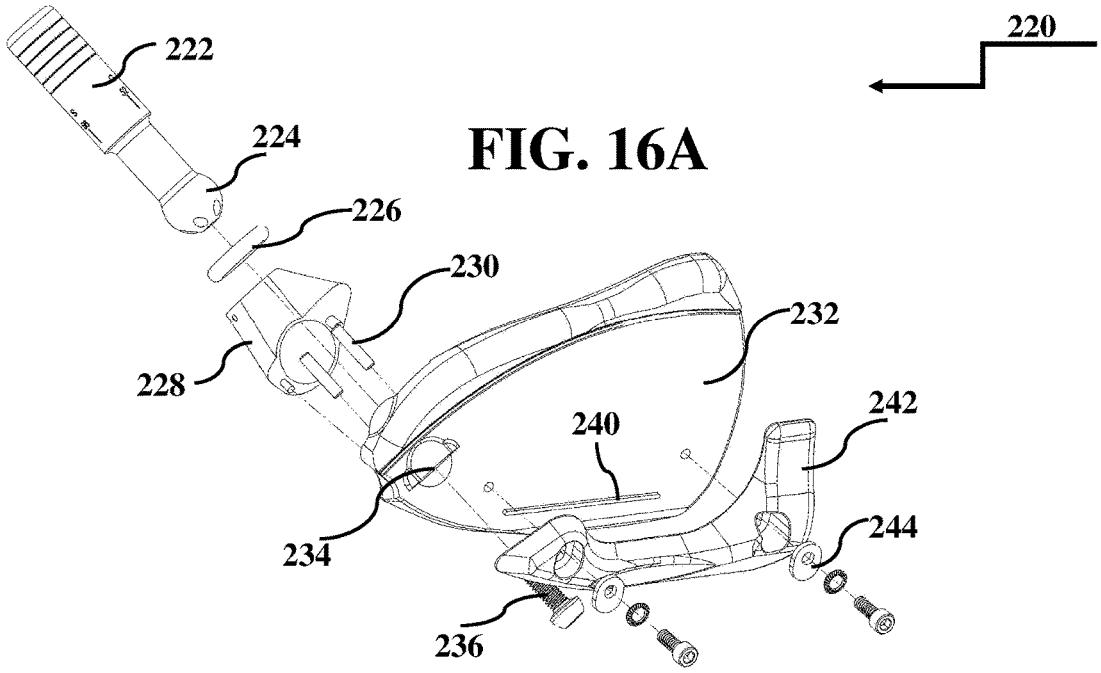
FIG. 16A is an exploded perspective view of the golf club head with the hosel.
Figure 16B:
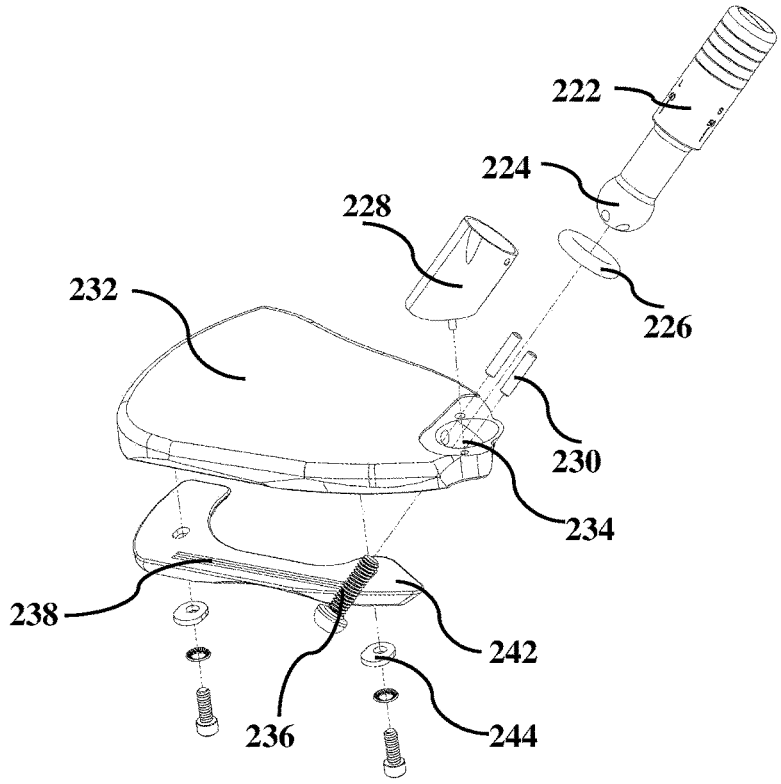
FIG. 16B is another view of the exploded perspective.

FIG. 16A is an exploded perspective view of the full construction of a preferred mode of a wedge made in accordance with the present invention. An iron golf club head is generally denoted by numeral 220, including a hosel 222 with a ball socket 224 inserting through a trim piece 225 into a faceplate 232. Trim piece 228 is held securely against ball socket 224 by o-ring 226. Ball socket 224 emanates through faceplate 232 and is secured therein by hosel screw 236. A rear flange 242 is secured against faceplate 236 and is positioned by offset location washer 244. A mounting ridge 240 is located on the back of faceplate 232 and matches to a complementary mounting ridge receiver as shown in FIG. 16B. FIG. 16B is another exploded perspective view from another angle illustrating how location pins 230 hold the hosel 222 in place. Bounce location slots 238 are shown as having numerous slot locations in order to be adjustable against the mounting ridge 240 of FIG. 16A. This allows for adjustment for mounting ridge 240 and support for launching the ball.

Figure 17A:
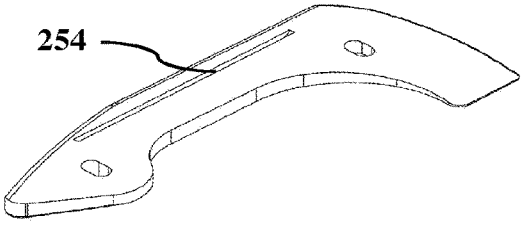
FIG. 17A is a front elevational view of a space plate.
Figure 17B:
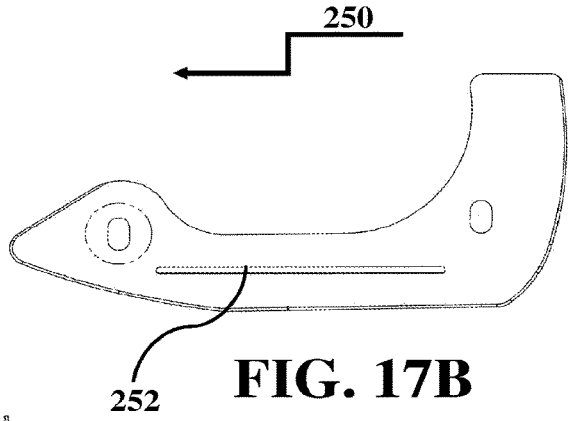
FIG. 17B is a top perspective view of a space plate.
Figure 17C:
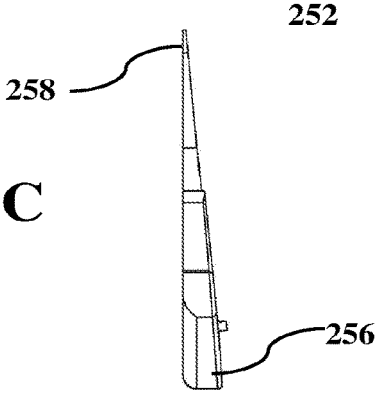
FIG. 17C is a side elevational view of a space plate showing the width difference.
Figure 17D:
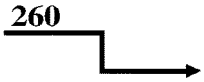
FIG. 17D is a font front view of a washer for the offset location.
Figure 17E:
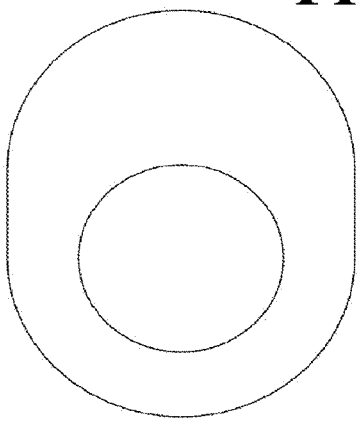
FIG. 17E is a side elevational view of the washer showing the difference in width.
Figure 17E:
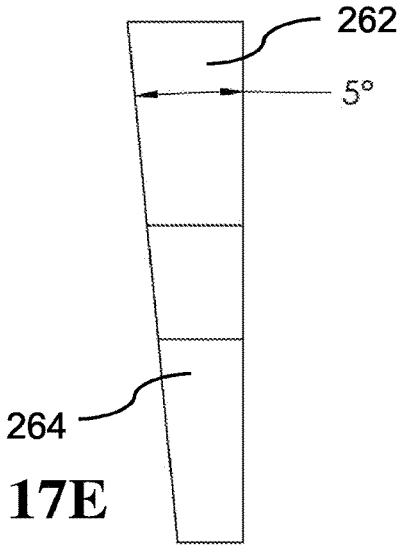

Looking collectively next to FIG.'S 17A-17E, a space plate generally denoted by 250 includes a bounce location slot 254 for receiving a mounting ridge 252 as shown in FIG. 17B. This space plate 250 may be inserted between the rear flange 242 of FIG. 16A and faceplate 232 in order to act as a sole width adapter. As it will act as an intermediate piece between rear flange 242 and faceplate 232, it also will include bounce location slots 254 to receive mounting ridge 240. FIG. 17C is a side elevational view of space plate 250 and illustrates the difference in width of material between the tip 258 and sole width adapter base 256. Space plate 250 will help to adjust bounce angle when launching the ball. In addition, FIGS. 17D and 17E are most advantageously used with an angled sole width adapter washer generally denoted by 260. Washer 260 is an offset washer enabled to accommodate the adjustable height of the mounting ridge 242 one installed. Side elevational view of washer 260 includes a width difference having a wider portion 262 and a narrower portion 264 in order to accommodate space plate 250 when it is installed.

In another aspect of the present invention, a one-piece loft and lie adapter is illustrated in FIGS. 18A, 18B, 18C, and 18D for use on iron clubs. It is envisioned that this one-piece loft and lie adapter can create varied loft and lie settings in 1° or more increments, so that one could almost use whatever faceplate profile they want, and then adjust the loft and lie angles to create a desired loft and lie angle, capable of being from 18° to 62° in loft and corresponding lie angles. Thus, a golfer could pick and choose their preferred set-up. As such, a golfer could pick his preferred faceplate profile and then pick one of different angled single piece hosel configurations to make his or her perfect golf club.

Figure 18A:
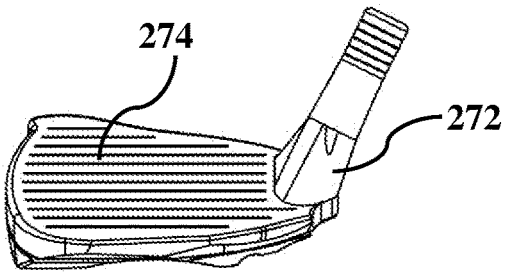
FIG. 18A is a face of view of a golf club head with an interchangeable one piece hosel adapter.
Figure 18C:
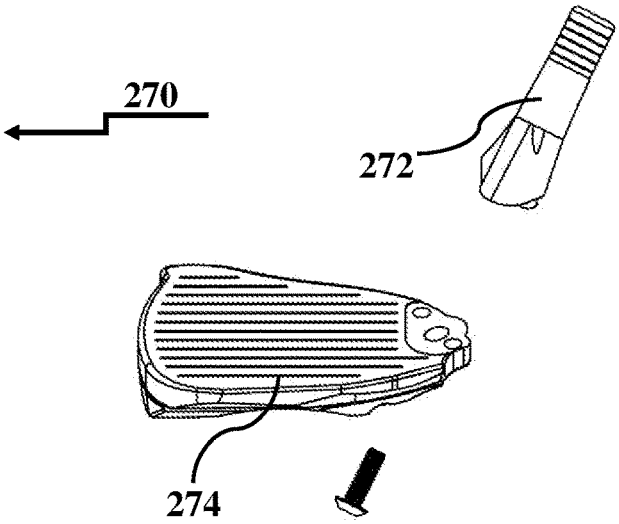
FIG. 18C is an unassembled face view.
Figure 18B:
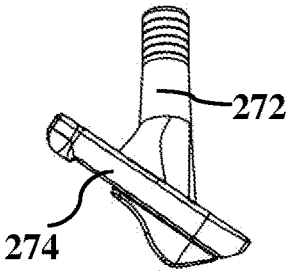
FIG. 18B is an assembled toe view with the hosel in place.
Figure 18D:
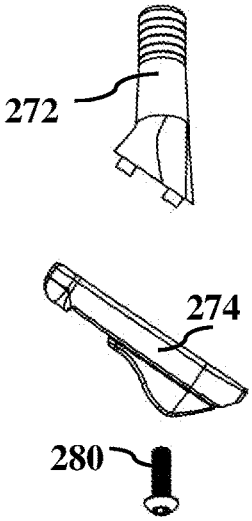
FIG. 18D is an unassembled toe view.

Still viewing FIGS. 18A, 18B, 18C, and 18D, an assembled iron club shown as 270 with an interchangeable one-piece hosel adapter 272 is shown attached to an iron faceplate 274. The interchangeable one-piece hosel adapter 272 is capable of changing various faceplates into a multiple set of irons. For example, a faceplate 274 is capable of receiving various hosel adapters, which are pre-manufactured to varying angles. One iron faceplate can accommodate various hosel adapters, such that an iron club can be changed into a different loft and/or lie angle setting by interchanging a one-piece hosel adapter having a prescribed angle for another hosel adapter with a different prescribed angle. FIG. 18B is a side elevational view of an assembled toe view of a wedge faceplate 274 with an interchangeable one-piece hosel adapter 272 attached thereto. FIG. 18D is an unassembled toe view of FIG. 18B. For another view, FIG. 18C shows an unassembled face view of the interchangeable one-piece hosel adapter of FIG. 18A. Consequently, the loft of the iron can be adapted by interchanging the one-piece hosel adapter.

Since a typical hosel in prior art iron golf club heads are relatively heavy when compared to the much lighter weight aluminum hosel of the present invention, the relative placement of weight is shifted down to the faceplate of the head. A typical prior art hosel weighs about 70 grams, while the lightweight hosel of the present invention is about 10 grams. This means that nearly 60 grams of weight is removed from the hosel area, such that the relative weight is repositioned into the club head. By this shifting of the relative weight to the faceplate, an advantage arises which realigns the weight to the center of the club face. In addition, due to the higher position of the hosel on the faceplate, the center line of the hosel of the present invention intersects more closely to the center of the club face. In prior art hosel locationing, the center line of those hosels departs outside the hitting surface of the faceplate itself. Due to these advantages, the club exhibits a much higher moment of inertia and head stability on off center contact.

Figure 19A:
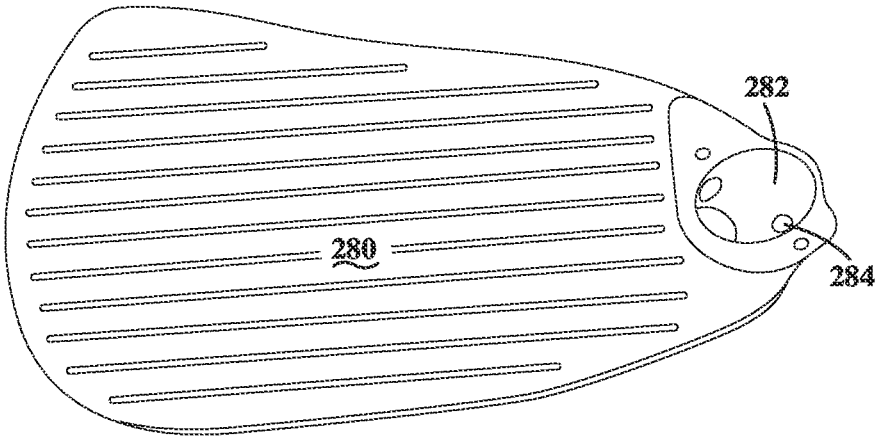
FIG. 19A is a front view of a faceplate for a 4, five, or six iron.
Figure 19B:
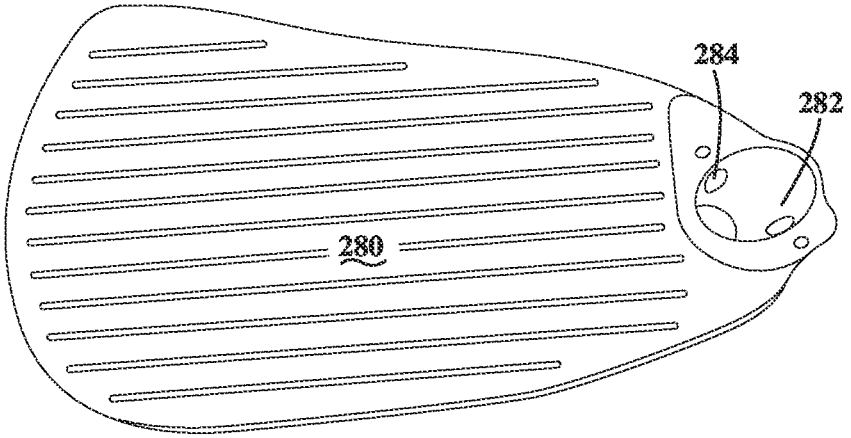
FIG. 19B is a front view of a faceplate for a seven, eight, or nine iron.
Figure 19C:
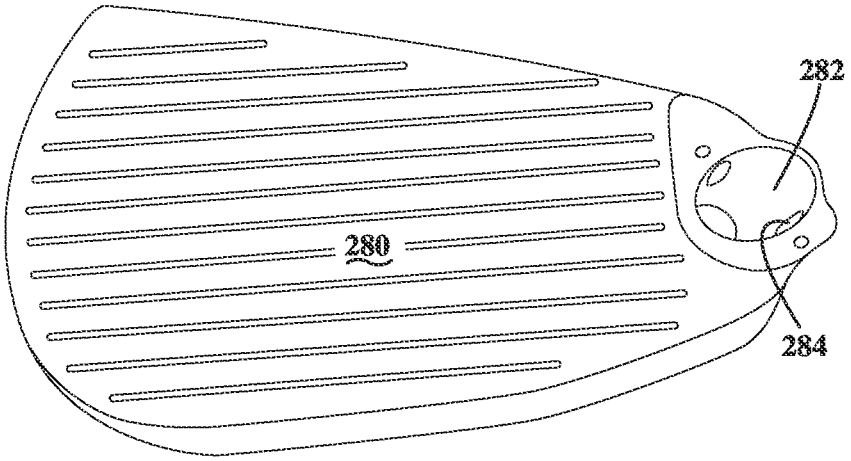
FIG. 19C is a front view of a faceplate for a wedge or putter.

FIGS. 19A through 19C helps to explain the cafeteria style of the various components that can be picked and chosen to create whatever golf club the golfer wants for his personal style. In general, FIG. 19A shows an iron faceplate 280 that is typically usable for a four, five, or six iron, while FIG. 19B may be recognized as a typical seven, eight or nine iron faceplate. To complete the clubs, FIG. 19C shows a faceplate that can be used from 46° to 62°. By utilizing the various loft adapter hosels as described below, a 4-iron can be adapted to a six iron by using one of the prescribed angle interchangeable one-piece hosels. Location pins 284 are adapted to receive a two piece hosel described above. Alternatively, a one piece hosel as in FIG. 18C may be utilized if the flat surface configuration is present, rather than having a ball socket 282 and location pins 284.

Looking next to FIGS. 20A-20E, yet another aspect of the present invention is shown as an iron golf club head, generally denoted by 300 including a faceplate 302 and a body 304. Hosel 306 emanates upwardly from the club body 304 with all of the same adjustability features described hereinabove with regard to the iron clubs. All of the interchangeable features disclosed above will be accommodated by this metal golf club. The same ball and socket receiver can be used on this golf club as is described above, and will receive the same type of hosel 306 as is illustrated above.

Figure 20A:
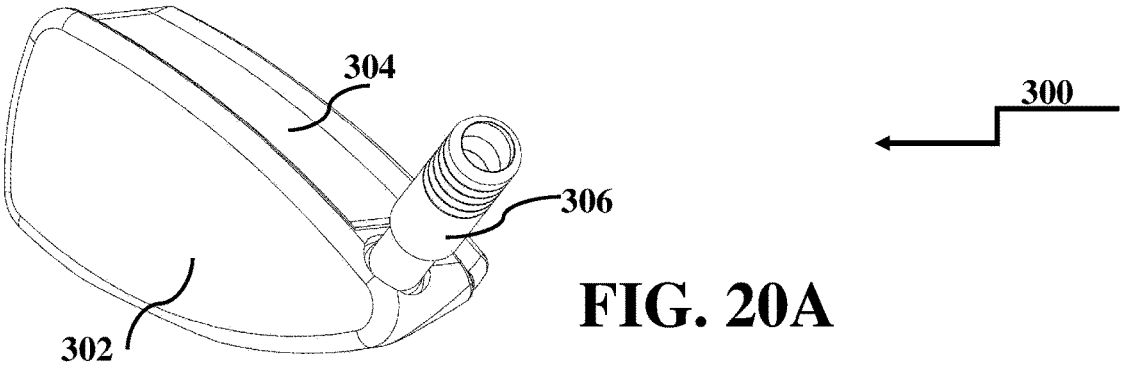
FIG. 20A is a front perspective view of a hybrid golf club head.
Figure 20B:
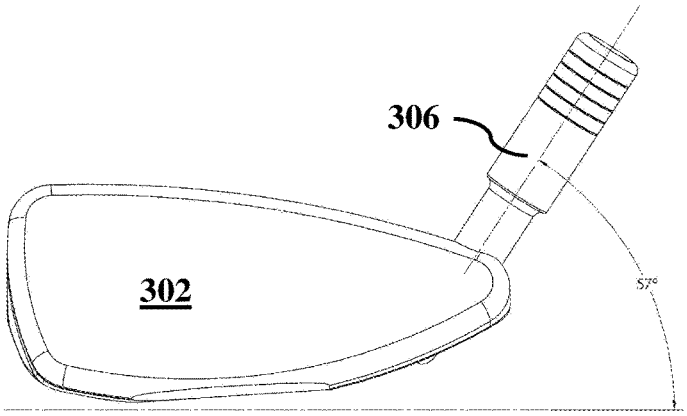
FIG. 20B is a side elevational view of a hybrid golf club head.
Figure 20C:
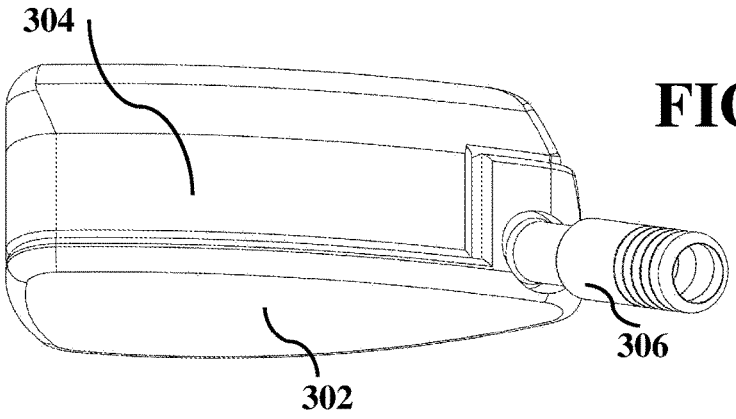
FIG. 20C is a top perspective view of the hybrid golf club head.
Figure 20D:
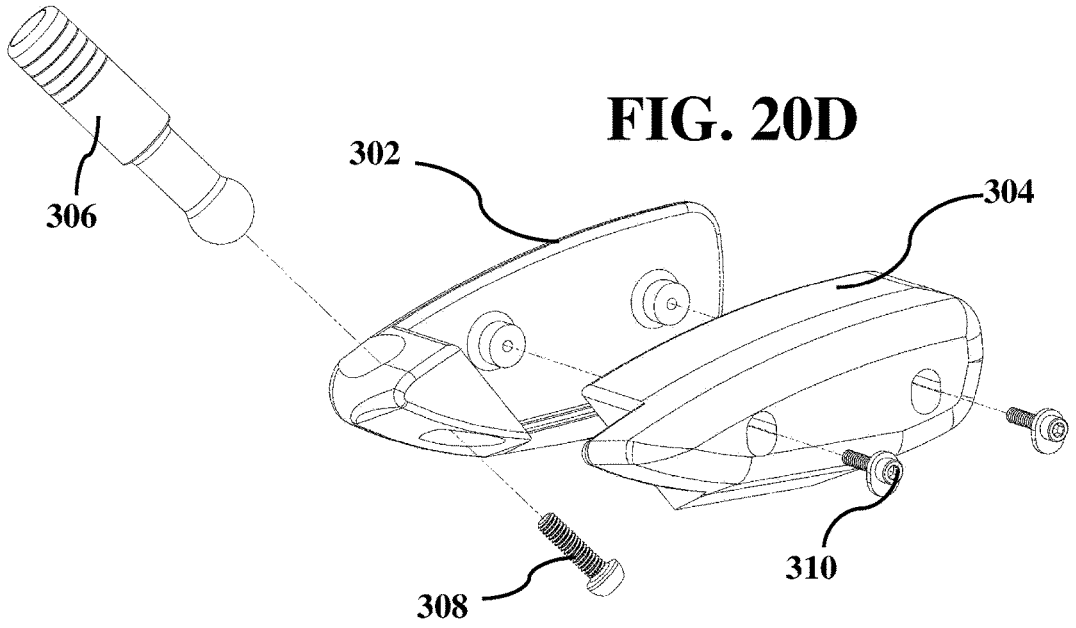
FIG. 20D is an exploded perspective view of the hybrid golf club head.
Figure 20E:
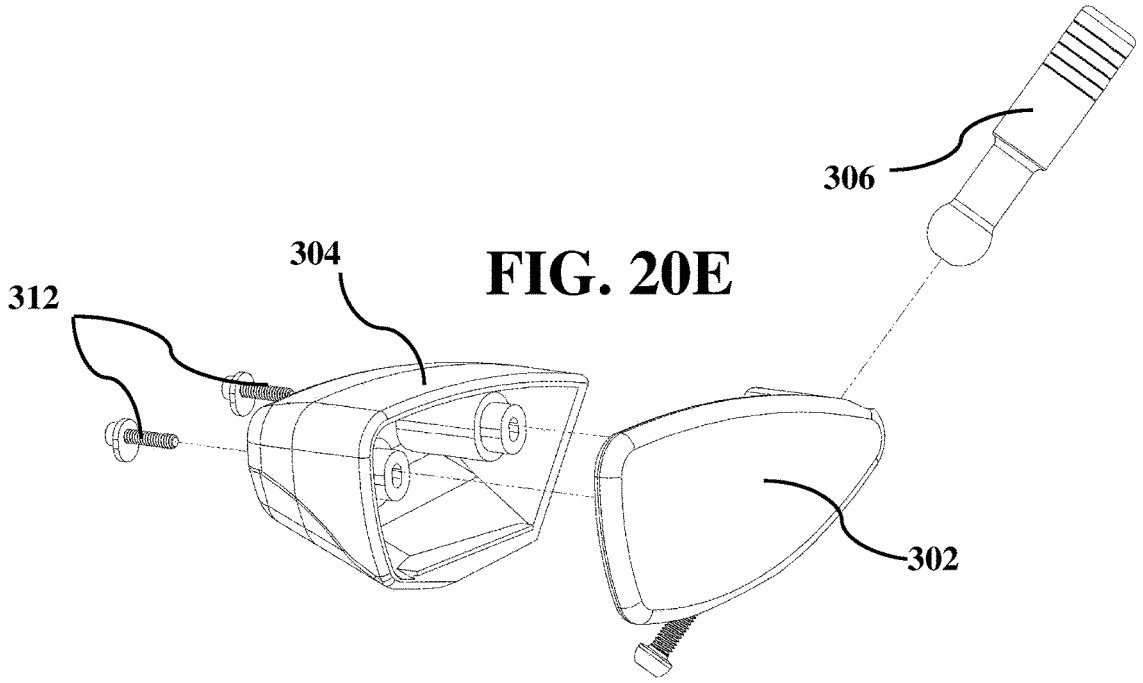
FIG. 20E is an exploded perspective view of the hybrid golf club head from another angle.

FIGS. 20D and 20E are exploded perspective views of the golf club head shown in FIG. 20A. This golf club may be configured as two pieces secured together with body fasteners 310 or maybe three pieces secured together by body fasteners 310. In essence, the club body 304 may be a single piece, or maybe multiple pieces, while the club body 304 can be adjusted height wise by offset location washers 312. The offset location washers 312 may be the same as illustrated in FIG. 17D, so that in a first direction, the offset location washer will hold the club body 304 in relation to faceplate 302 in a lower configuration. If a loft adjustment is made with a hosel adjustment, such that loft is increased, the offset location washer can be reversed to essentially raise the position of the club body 304, thereby offsetting the lowering of the club body once the loft has been increased.

Figure 21A:
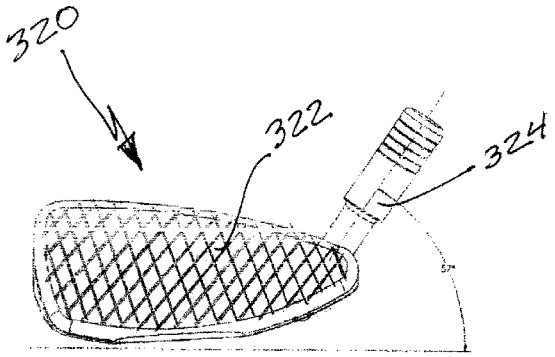
FIG. 21A is a side elevational view of a hybrid golf club head illustrating the location of the textured surface.
Figure 21B:
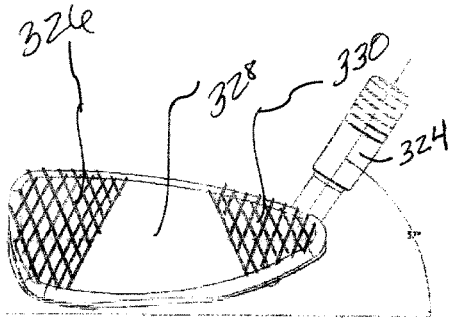
FIG. 21B is a side elevational view of a hybrid golf club head illustrating the location of the textured surface.
Figure 21C:
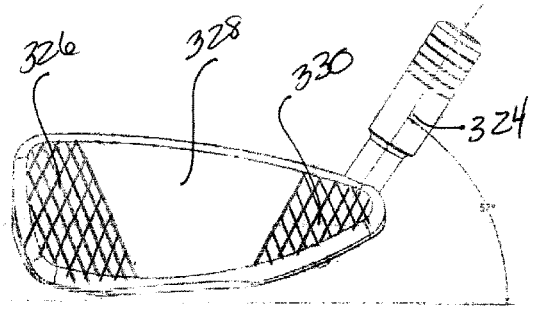
FIG. 21C is a side elevational view of a hybrid golf club head illustrating the location of the textured surface.
Figure 21D:
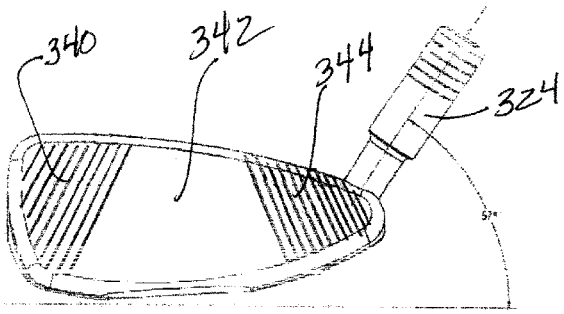
FIG. 21D is a side elevational view of a hybrid golf club head illustrating the location of the textured surface.
Figure 21E:
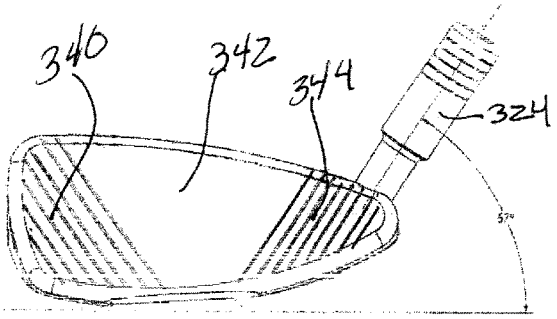
FIG. 21E is a side elevational view of a hybrid golf club head illustrating the location of the textured surface.

Looking finally to FIGS. 21A-21E, there is shown various textured milled surface configurations that will enhance the gear effect on heel and toe contact of the golf club face. This textured pattern may be applied in degrees of surface texture on various locations in a gradient fashion where the roughness may be increased as it travels outwardly toward the toe and inwardly towards the heel areas. A golf club head is generally denoted by the 320 and includes all over textured surface with a 30° angle opposing diamond patterned texture 322, creating a texture over the entire surface of faceplate 322. Hosel 324 in FIG. 21A is shown attached to golf club head 320. FIG. 21B shows another aspect where the diamond pattern of FIG. 21A, is applied only to the toe region 326 and heel region 330, leaving the center region 328 untextured. The textured pattern may be applied with a gradient of roughness from the untextured central surface 328 having increasing roughness as it travels outwardly to the toe and heel regions. It is anticipated that the textured milled surface will enhance the gear effect on a club that has a roll and bulge face profile. The untextured center 328 may be in numerous configurations as shown in these FIGS. 21A-21E. As can be seen in FIGS. 21B and 21C, the untextured portion 328 may be either wider at the bottom or wider at the top, or alternatively, may be a rectangular portion. Looking now to FIGS. 21D and 21E, a single pass milled texture surface can be applied at the toe region 340 and heel region 344, again leaving a central non-textured surface 342. With a roll and bulge faceplate profile, it would be advantageous to apply the single pass texture on both the toe region 340 and heel region 344. In each instance, hosel 324 is received within the golf club head 320.

The foregoing description of preferred aspects of the invention has been presented for purposes of illustration and description. It is not intended to be exhaustive or to limit the invention to the precise form disclosed. Obvious modifications or variations are possible in light of the above teachings with regards to the specific aspects. The aspect was chosen and described in order to best illustrate the principles of the invention and its practical applications to thereby enable one of ordinary skill in the art to best utilize the invention in various aspects and with various modifications as are suited to the particular use contemplated.

INDUSTRIAL APPLICABILITY

The present invention finds utility in the golf club manufacturers industry, and especially in the golf club industry desiring adjustable golf clubs.

What is claimed is:

1. An adjustable interchangeable golf club head, comprising:

a faceplate-based platform capable of receiving various performance enhancing interchangeable adjustment components, the faceplate-based platform including a back surface and a face surface, the face surface defining a surface plane, at least a portion of the face surface of the faceplate made with embossing yielding a total surface depth of less than 180 micro inches, thereby adding additional roughness while remaining in compliance with USGA regulations;

an interchangeable, independent one-piece hosel adapter received by the face surface of the faceplate-based platform, whereby the loft of the club can be adapted by interchanging the one-piece hosel adapter, such that the relative placement of weight is shifted down to the faceplate which realigns the weight to the center of the club; and a bounce angle adjustment flange removably and adjustably attachable to the back surface of the faceplate-based platform, said bounce angle adjustment flange including an interchangeable rear flange, providing the ability to modify the bounce angle of the club upon swinging the club.

2. The golf club of claim 1, further comprising a flange mounting ridge located on the back surface of the faceplate-based platform and corresponding to bounce location slots having numerous slot locations in order to be adjustable against the flange mounting ridge, allowing for adjustment for the flange mounting ridge and support for launching the ball.

3. The golf club of claim 1, further comprising recessed openings in the interchangeable rear flange to secure the interchangeable rear flange to the golf club head by securement devices through offset washers.

4. The golf club of claim 3, wherein the securement devices can slightly travel, thereby providing bounce angle adjustment.

5. An adjustable interchangeable golf club, comprising:

a faceplate-based platform capable of receiving various interchangeable adjustment components;

an adjustable hosel ball and socket feature;

a bounce angle adjustment flange;

a flange mounting ridge located on the back of the faceplate-based platform and corresponding to bounce location slots having numerous slot locations in order to be adjustable against the flange mounting ridge, allowing for adjustment for the flange mounting ridge and support for launching the ball; and a space plate for insertion between the bounce angle adjustment flange and the faceplate-based platform in order to act as a sole width adapter, said sole width adapter including bounce location slots for receiving a flange mounting ridge most advantageously used with an offset washer enabled to accommodate the adjustable height of the flange mounting ridge once installed.

6. An adjustable interchangeable golf club head, comprising:

a faceplate-based platform capable of receiving various performance enhancing interchangeable adjustment components;

an interchangeable, independent one-piece hosel adapter capable of being received by the faceplate-based platform, whereby the loft of the club can be adapted by interchanging the one-piece hosel adapter, such that the relative placement of weight is shifted down to the faceplate which realigns the weight to the center of the club; and a bounce angle adjustment flange removably and adjustably attachable to the faceplate-based platform, said bounce angle adjustment flange including an interchangeable rear flange, providing the ability to modify the bounce angle of the club upon swinging the club, depending on the location of the rear flange, and wherein the faceplate-based platform includes a planar surface, substantially without any traditional dishing milling effects, providing a true advantage during the milling process.

7. An adjustable interchangeable golf club head, comprising:

a faceplate-based platform capable of receiving various performance enhancing interchangeable adjustment components, the faceplate-based platform including a back surface and a face surface, at least a portion of the face surface of the faceplate made with embossing yielding a total surface depth of less than 180 micro inches, thereby adding additional roughness while remaining in compliance with USGA regulations;

an interchangeable, independent one-piece hosel adapter capable of being received by the faceplate-based platform, whereby the loft of the club can be adapted by interchanging the one-piece hosel adapter, such that the relative placement of weight is shifted down to the faceplate which realigns the weight to the center of the club; and a bounce angle adjustment flange removably attachable to the back surface of the face-plate-based platform, said bounce angle adjustment flange including an interchangeable rear flange, providing the ability to modify the bounce angle of the club;

wherein the faceplate-based platform includes a textured surface with a 30° angle opposing diamond patterned texture on at least a portion of the face surface of the faceplate-based platform.

* * * * *